US008502752B2

(12) United States Patent
Kasai

(10) Patent No.: US 8,502,752 B2
(45) Date of Patent: Aug. 6, 2013

(54) ELECTRO-OPTICAL APPARATUS, HAVING A PLURALITY OF WIRINGS FORMING A DATA LINE DRIVING METHOD THEREOF, AND ELECTRONIC DEVICE

(75) Inventor: Toshiyuki Kasai, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 586 days.

(21) Appl. No.: 12/730,613

(22) Filed: Mar. 24, 2010

(65) Prior Publication Data

US 2010/0253708 A1 Oct. 7, 2010

(30) Foreign Application Priority Data

Apr. 1, 2009 (JP) ..... 2009-089617

(51) Int. Cl.
*G09G 3/30* (2006.01)
*G09G 3/10* (2006.01)

(52) U.S. Cl.
USPC ..... 345/76; 315/169.3

(58) Field of Classification Search
USPC ..... 345/76
See application file for complete search history.

(56) References Cited

U.S. PATENT DOCUMENTS

| | | | | |
|---|---|---|---|---|
| 5,714,968 | A | 2/1998 | Ikeda | |
| 5,940,053 | A | 8/1999 | Ikeda | |
| 6,011,529 | A | 1/2000 | Ikeda | |
| 6,583,581 | B2 * | 6/2003 | Kaneko et al. | 315/169.3 |
| 6,765,560 | B1 | 7/2004 | Ozawa | |
| 6,882,113 | B2 * | 4/2005 | Kaneko et al. | 345/76 |
| 7,245,278 | B2 * | 7/2007 | Hu et al. | 345/76 |
| 8,207,951 | B2 | 6/2012 | Nishinohara | |
| 2004/0189553 | A1 * | 9/2004 | Kabuto et al. | 345/75.2 |
| 2005/0024297 | A1 * | 2/2005 | Shin | 345/76 |
| 2005/0057456 | A1 * | 3/2005 | Hu et al. | 345/76 |
| 2005/0110421 | A1 * | 5/2005 | Matsumoto et al. | 345/76 |
| 2006/0001617 | A1 * | 1/2006 | Shin et al. | 345/76 |
| 2006/0120203 | A1 * | 6/2006 | Kageyama et al. | 365/230.06 |
| 2006/0139255 | A1 * | 6/2006 | Kim et al. | 345/76 |
| 2006/0262051 | A1 * | 11/2006 | Kim et al. | 345/76 |
| 2006/0262130 | A1 * | 11/2006 | Kim et al. | 345/589 |
| 2009/0195534 | A1 | 8/2009 | Kasai | |

FOREIGN PATENT DOCUMENTS

| | | |
|---|---|---|
| JP | A-8-54835 | 2/1996 |
| JP | A-8-54836 | 2/1996 |
| JP | A-2000-122608 | 4/2000 |
| JP | A-2000-276109 | 10/2000 |
| JP | A-2009-048061 | 3/2009 |

* cited by examiner

*Primary Examiner* — Adam J Snyder
(74) *Attorney, Agent, or Firm* — Oliff & Berridge, PLC

(57) ABSTRACT

A electro-optical apparatus includes: a plurality of unit circuits arranged to correspond to intersections of scanning lines and data lines; a scanning line driving circuit; and a data line driving circuit. Each unit circuit includes: an electro-optical element which provides gradation corresponding to the data electric potential; a capacitor element which has a first electrode connected to a capacitor line and a second electrode connected to the data line; and a switching element. A second electrode of the capacitor element included in one of the plurality of unit circuits is connected to one wiring of the respective wirings included in the data line. The second electrode of the capacitor element included in another unit circuit is arranged in parallel with the one unit circuit along an extension direction of the data line and is connected to another wiring of the respective wirings included in the data line.

17 Claims, 13 Drawing Sheets

ELECTRO-OPTICAL APPARATUS, HAVING A PLURALITY OF WIRINGS FORMING A DATA LINE DRIVING METHOD THEREOF, AND ELECTRONIC DEVICE

BACKGROUND

1. Technical Field

The present invention relates to an electro-optical apparatus including an organic EL (electro luminescent) element, a liquid crystal or the like, a driving method thereof and an electronic device.

2. Related Art

An electro-optical apparatus including an organic EL element or the like as an electro-optical element is provided in the related art. In the electro-optical apparatus, a variety of driving circuits is provided for supplying a predetermined electric current or voltage to the organic EL element or the like. Such a driving circuit may include, for example, a capacitor element which is connected in parallel with the organic EL element, in addition to the organic EL element. In this case, a data electric potential is supplied to a positive electrode of the organic EL element and one electrode of the capacitor element, and a reference electric potential is supplied to a negative electrode of the organic EL element and the other electrode of the capacitor element. According to this configuration, the supply of electric current due to electric charges, which correspond to the data electric potential, and which are stored in the capacitor element, may be performed with respect to the organic EL element, and thus, driving of the organic EL element can be stably performed.

Such an electro-optical apparatus is disclosed, for example, in JP-A-2000-122608.

However, in the above described electro-optical apparatus, there are the following problems. That is, in order to obtain a sufficient light emitting amount of the organic EL element (a time integral value of light emitting luminance), it is necessary to increase the amount of electric charges stored in the capacitor element. Thus, it is necessary to remarkably increase the capacitance of the capacitor element. However, since physical area for installation of each individual driving circuit is limited, it is difficult to realize such a large amount value.

Accordingly, in order to solve the problems, the present applicant has proposed a technology disclosed in U.S. Patent Application Publication No. 2009/0195534. Here, a capacitor element included in each of a plurality of driving circuits (unit circuits) is used for driving one organic EL element. As a simple example, in the case where the driving circuits are simply arranged only in one column and they are is N in number (accordingly, the number of the capacitor elements and organic EL elements is also N), when driving any one organic EL element, firstly, charging according to a data electric potential corresponding to the organic EL element is concurrently performed with respect to N capacitor elements included in all the driving circuits, and then, concurrent discharging of the N capacitor elements (that is, electric current supply) is performed for the organic EL element.

With this configuration, there is hardly any trouble with respect to the above described problems.

However, the above described technology has room for improvement. That is, according to the above described examples, in order to drive any one organic EL element, concurrent charging with respect to all the N capacitor elements and concurrent discharging should be performed. However, time for sufficiently performing the concurrent charging and the concurrent discharging is likely to be relatively long. Accordingly, in order to secure the time for sufficiently performing the concurrent charging or the concurrent discharging, driving timing of each organic EL element becomes lengthened, or in order to maintain constant writing time and light emitting time (they correspond to the charging and discharging respectively), sufficient charging or discharging may not be performed. As a result, luminance irregularity or the like is generated.

SUMMARY

An advantage of some aspects of the invention is that it provides an electro-optical apparatus capable of solving at least a part of the above problems, a driving method thereof, and an electronic device.

Further, the invention provides an electro-optical apparatus, a driving method thereof, and an electronic device capable of solving the above problems relating to the electro-optical apparatus, the driving method thereof, and the electronic device.

An electro-optical apparatus according to a first aspect of the invention includes: a plurality of unit circuits which is arranged to correspond to intersections of a plurality of scanning lines and a plurality of data lines; a plurality of wirings which forms each of the plurality of data lines; a scanning line driving circuit which sequentially selects one scanning line in every driving period included in a unit period; and a data line driving circuit which outputs data electric potentials corresponding to gradation data of the unit circuits corresponding to the scanning line selected in the driving period in the unit period to any one of the respective wirings included in each data line, in every writing period which is included in each unit period before the driving period begins, wherein each of the plurality of unit circuits includes: an electro-optical element which provides gradation corresponding to the data electric potential; a capacitor element which has a first electrode connected to a capacitor line and a second electrode connected to any one of the respective wirings included in the data line; and a switching element which is arranged between the second electrode and the electro-optical element and is switched on when the scanning line is selected by the scanning line driving circuit to as to conduct between the second electrode and the electro-optical element, wherein the second electrode of the capacitor element included in one of the plurality of unit circuits is connected to one wiring of the respective wirings included in the data line, and wherein the second electrode of the capacitor element included in another unit circuit arranged in parallel with the one unit circuit along an extension direction of the data line is connected to another wiring of the respective wirings included in the data line.

According to the first aspect of the invention, for example, the following operations may be performed.

That is, firstly, in the writing period, charging in the capacitor element in one unit circuit, which is connected to one wiring is performed. In this case, "any one of the respective wirings" to which the data line driving circuit outputs the data electric potentials corresponds to the one wiring. Secondly, in the driving period after the writing period, discharging of the capacitor elements is performed with respect to the electro-optical elements included in the unit circuits (or just one unit circuit) corresponding to the scanning lines which are selection targets.

In such an operation, the unit circuits involved in the charging in the capacitor elements and the discharging thereof include only the capacitor elements connected to the one wiring. That is, in the first aspect of the invention, as it is assumed that there are the "other unit circuits" connected to the "another wiring", capacitor elements in all the unit circuits do not have to be involved in such charging and discharging.

Meanwhile, the above described first and second operations are similarly performed with respect to the capacitor elements in the other unit circuits, which are connected to the other wiring. (In this case, one unit circuit connected to the one wiring is not involved in the above described charging and discharging.)

As described above, according to the invention, since the number of the capacitor elements which are charging or discharging targets is small compared with the total number of the capacitor elements, time for charging or discharging may be relatively lengthened. Thus, according to the invention, disadvantage due to an insufficient amount of charging time or discharging time, for example, luminance irregularity or the like, may be effectively prevented.

Further, an electro-optical apparatus according to a second aspect of the invention includes: a plurality of unit circuits which is arranged to correspond to intersections of a plurality of scanning lines and a plurality of data lines; a plurality of wirings which forms each of the plurality of data lines; a scanning line driving circuit which sequentially selects one scanning line in every driving period included in a unit period; a data line driving circuit which outputs data electric potentials corresponding to gradation data of the unit circuits corresponding to the scanning line selected in the driving period in the unit period to any one of the respective wirings included in each data line, in every writing period which is included in each unit period before the driving period begins; and a plurality of first switching elements which is arranged between the respective wirings included in the plurality of data lines and the data line driving circuit, wherein each of the plurality of unit circuits includes: an electro-optical element which provides gradation corresponding to the data electric potential; a second switching element which is arranged between one wiring included in the data line and the electro-optical element and is switched on when the scanning line is selected by the scanning line driving circuit so as to conduct between the wiring and the electro-optical element, wherein the second switching element included in one of the plurality of unit circuits is connected to one wiring of the respective wirings included in the data line, wherein the second switching element included in another unit circuit arranged in parallel with the one unit circuit along an extension direction of the data line is connected to another wiring of the respective wirings included in the data line, and wherein when the data line driving circuit outputs the data electric potential to one wiring included in the data line, the first switching element corresponding to the wiring is switched on in the writing period and conducts between the wiring and the data line driving circuit to store electric charges corresponding to the data electric potential in capacitance associated with the wiring, and is switched off in the driving period and cuts off the conduction between the wiring and the data line driving circuit.

According to the invention, function effects are provided which are similar to the function effects of the electro-optical apparatus according to the first aspect of the invention.

In the second aspect of the invention, the charging target is the "capacitance associated with the wiring" included in the data line, and further, the discharging target is also the "capacitance". The discharging is realized by cutting off the conduction between the wiring and the data line driving circuit in the driving period, and by conducting between the wiring and the electro-optical element on the basis of the above described configuration.

Here, for example, capacitance which is parasitic on the wiring itself is included in the "capacitance associated with the wiring" (more specifically, capacitance or the like which is parasitic on between the wiring and one electrode which forms the electro-optical element). Further, the "capacitor elements" for forming the electro-optical apparatus according to the above described first aspect of the invention are included in the "capacitance associated with the wiring". (Accordingly, this means that the electro-optical apparatus according to the second aspect is larger than that of the first aspect in an acquisition range.)

As described above, in the second aspect of the invention, since installation of the "capacitor elements" is not necessary, in addition to the function effects obtained by the electro-optical apparatus according to the first aspect, a reduction in costs can be achieved which are equal to the installation cost for the capacitor elements. Further, similarly, since reduction in size of the unit circuit may be realized, thereby high definition can be achieved.

In the electro-optical apparatus according to the first and second aspects of the invention, the unit period relating to one of the unit circuits may overlap with at least part of the unit period relating to another unit circuit.

Accordingly, since the unit periods relating to one unit circuit and another unit circuit partly overlap with each other, the charging time or discharging time may be further lengthened. Further, due to the overlapping between the unit periods, in a predetermined time, the electro-optical elements in all the unit circuits may be effectively driven.

In the aspect of the invention, the "unit period relating to the unit circuit" refers to the corresponding period in the case where output of the data electric potential and selection of the scanning line are performed for the unit circuit in the writing period and the driving period so that the electro-optical element in the unit circuit can become predetermined gradation.

Further, in the electro-optical apparatus according to the first or second aspect of the invention, the data line driving circuit may include a switching unit which determines which wiring of the respective wirings the data electric potential is supplied to.

Accordingly, since the data line driving circuit includes the switching unit, supply or the like of the data electric potential to the respective wirings included in the data line is appropriately performed, and thus, the effects according to the aspect of the invention may be effectively obtained.

In addition, more specifically, for example, if one data line includes "two" wirings, during the writing period with respect to the one unit circuit, the data electric potential is supplied to one of the two wirings; and during the writing period with respect to another unit circuit, the data electric potential is supplied to the other wiring. In this case, during the latter writing period with respect to the other unit circuit, since the one of the wirings is opened, the corresponding period may correspond to the driving period with respect to the electric charge discharging from the capacitance associated with the wiring, that is, the driving period with respect to the one unit circuit. This means that at least part of the "driving period" and the "writing period" relating to the one and the other unit circuits may overlap.

In this way, the effects according to aspect of the invention may be effectively obtained.

Further, in the electro-optical apparatus according to the first or second aspect of the invention, the data line driving circuit may at least include a first data electric potential generating unit which generates the data electric potential supplied for one wiring of the respective wirings, and a second data electric potential generating unit which generates the data electric potential supplied for another wiring of the respective wirings independently of the generation of the data electric potential in the first data electric potential generating unit.

According to the aspect of the invention, since the data line driving circuit includes two divided independent configurations of the first and second data electric potential generating units, for example, an output of the data electric potential to the one wiring and an output of the data electric potential to the other wiring may be concurrently performed. This means that at least part of the "writing periods" relating to the one and the other unit circuits may overlap.

Here, as described in the previous aspect, at least part of the "driving period" and the "writing period" relating to the one and another unit circuits may overlap.

Accordingly, the effects according to the above described the aspect of the invention may be effectively obtained.

Further, the electro-optical apparatus according to the first or second aspect of the invention may further include an auxiliary capacitor element which has an electrode connected to the wiring, in addition to the capacitor element in each unit circuit or the capacitance associated with the wiring.

According to the aspect of the invention, in the case where total capacitance of the respective capacitor elements connected to the wiring corresponding to the unit circuits or capacitance associated with the wiring is small compared with capacitance necessary for obtaining a sufficient light emitting amount of the electro-optical elements in the unit circuits corresponding to the selected scanning line, an insufficient amount thereof can be compensated by capacitance of the auxiliary capacitor element.

In fact, the above described effects are more significant in consideration of a case where charging and discharging which uses all the capacitor elements or all the capacitance associated with all the wirings are not performed and thus the insufficient amount may be easily generated.

In addition, in the electro-optical apparatus according to the first or second aspect of the invention, each data line may include an even number of wirings, and a half of the wirings may be arranged on one side of the unit circuit and the remaining half thereof may be arranged on the other side of the unit circuit.

Accordingly, a layout of the data line including the plurality of wirings and the unit circuits may be optimally performed (more specifically, for example, in a balanced manner).

Further, in the electro-optical apparatus according to the first or second aspect of the invention, one unit circuit and another unit circuit may form a single unit circuit group which is adjacently arranged along the extension direction of the data line, and the unit circuit group is repeatedly arranged along the extension direction of the data line.

According to the aspect of the invention, for example, along any one data line, the one unit circuit, the other unit circuit, the one unit circuit, the other unit circuit, the one unit circuit, and so on are repeatedly arranged. Thus, (all) the one unit circuits are commonly connected to one wiring included in the data line and (all) the other unit circuits are commonly connected to the other wiring included in the data lines.

In this way, in the aspect of the invention, since the one and the other unit circuits are arranged in a balanced manner, in the case where a certain unit circuit among all the unit circuits is the driving target, irregularity of electric charges supply to the electro-optical element included in the unit circuit does not occur.

Further, in order to solve the above problems, an electronic device according to an aspect of the invention includes the above described electro-optical apparatuses.

Since the electronic device includes the above described electro-optical apparatuses, time for charging in the capacitor elements or capacitance associated with the wiring or discharging thereof may be relatively lengthened, thereby displaying higher quality images.

Meanwhile, according to a first aspect of the invention, there is provided a driving method of an electro-optical apparatus including a plurality of wirings which forms a data line, a capacitor element which is connected to any one of the respective wirings, and an electro-optical element which provides predetermined gradation according to discharging of the capacitor element. The method includes the steps of: supplying a first data electric potential to one wiring included in the data line to store electric charges corresponding to the first data electric potential in the capacitor element connected to the one wiring; discharging the electric charges stored in the capacitor element connected to the one wiring to supply a voltage or electric current corresponding to the electric charges to the electro-optical element corresponding to the capacitor element; supplying a second data electric potential to another wiring included in the data line to store electric charges corresponding to the second data electric potential in the capacitor element connected to the other wiring; and discharging the electric charges stored in the capacitor element connected to the other wiring to supply a voltage or electric current corresponding to the electric charges to the electro-optical element corresponding to the capacitor element.

According to the aspect of the invention, in the step of supplying a first data electric potential and the step of discharging the electric charges stored in the capacitor element connected to the one wiring, the capacitor elements relating to the charging in the capacitor element or discharging thereof are limited to the capacitor elements connected to the "one wiring". That is, in the aspect of the invention, since it is presupposed that there is the capacitor elements connected to the "another wiring", all the capacitor elements do not have to be involved in such charging and discharging. This is also the case with the step of supplying a second data electric potential and discharging the electric charges stored in the capacitor element connected to the other wiring involved in the "another wiring".

According to the aspect of the invention, the number of capacitor elements which is a charging or discharging target is small compared with the number of at least all the capacitor elements, time for charging or discharging may be relatively lengthened. Thus, according to the aspect of the invention, disadvantage due to an insufficient amount of charging time or discharging time, for example, luminance irregularity or the like, may be effectively prevented.

According to the aspect of the invention, it is obviously understood that the electro-optical apparatus according to the above described aspect of the invention may be optimally driven.

In this aspect of the invention, the "capacitor element connected to one wiring" may be plural. Further, the "capacitor element connected to another wiring" may be similarly plural.

Further, according to a second aspect of the invention, there is provided a driving method of an electro-optical apparatus including a plurality of wirings which forms a data line, and an electro-optical element which is connected to any one of the respective wirings and provides predetermined gradation according to discharging of capacitance associated with the wiring. The method including: supplying a first data electric potential to one wiring included in the data line to store electric charges corresponding to the first data electric potential in the capacitance associated with the one wiring; discharging the electric charges stored in the capacitance associated with the one wiring to supply a voltage or electric current corresponding to the electric charges to the electro-optical element corresponding to the one wiring; supplying a second data electric potential to another wiring included in the data line to store electric charges corresponding to the second data electric potential in the capacitance associated with the other wiring; and discharging the electric charges stored in the capacitance associated with the other wiring to supply a voltage or electric current corresponding to the electric charges to the electro-optical element corresponding to the other wiring.

According to the aspect of the invention, function effects which are the same as the function effects obtained by the driving method of the electro-optical apparatus according to the first aspect of the invention are obtained. Here, the "capacitance associated with the wirings" is the same as that in the above description.

In the driving method of the electro-optical apparatus according to the first or second aspect of the invention, it is configured so that the step of supplying a first data electric potential is performed in parallel with at least one of the step of supplying a second data electric potential and the step of discharging the electric charges stored in the capacitor element connected to the other wiring, or the step of supplying a second data electric potential is performed in parallel with at least one of the step of supplying a first data electric potential and the step of discharging the electric charges stored in the capacitor element connected to the one wiring.

According to the aspect of the invention, for example, since the step of supplying a first data electric potential and the step of discharging the electric charges stored in the capacitor element connected to the other wiring are partly overlapped, the charging time or discharging time may be lengthened. Further, such overlapping may effectively drive the electro-optical elements in all the unit circuits in a predetermined period.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment according to the invention will be described with reference to FIGS. 1 and 2. In each drawing which will be referred to hereinafter, ratios of the sizes of respective parts may be different from those of real sizes.

Figure 1:
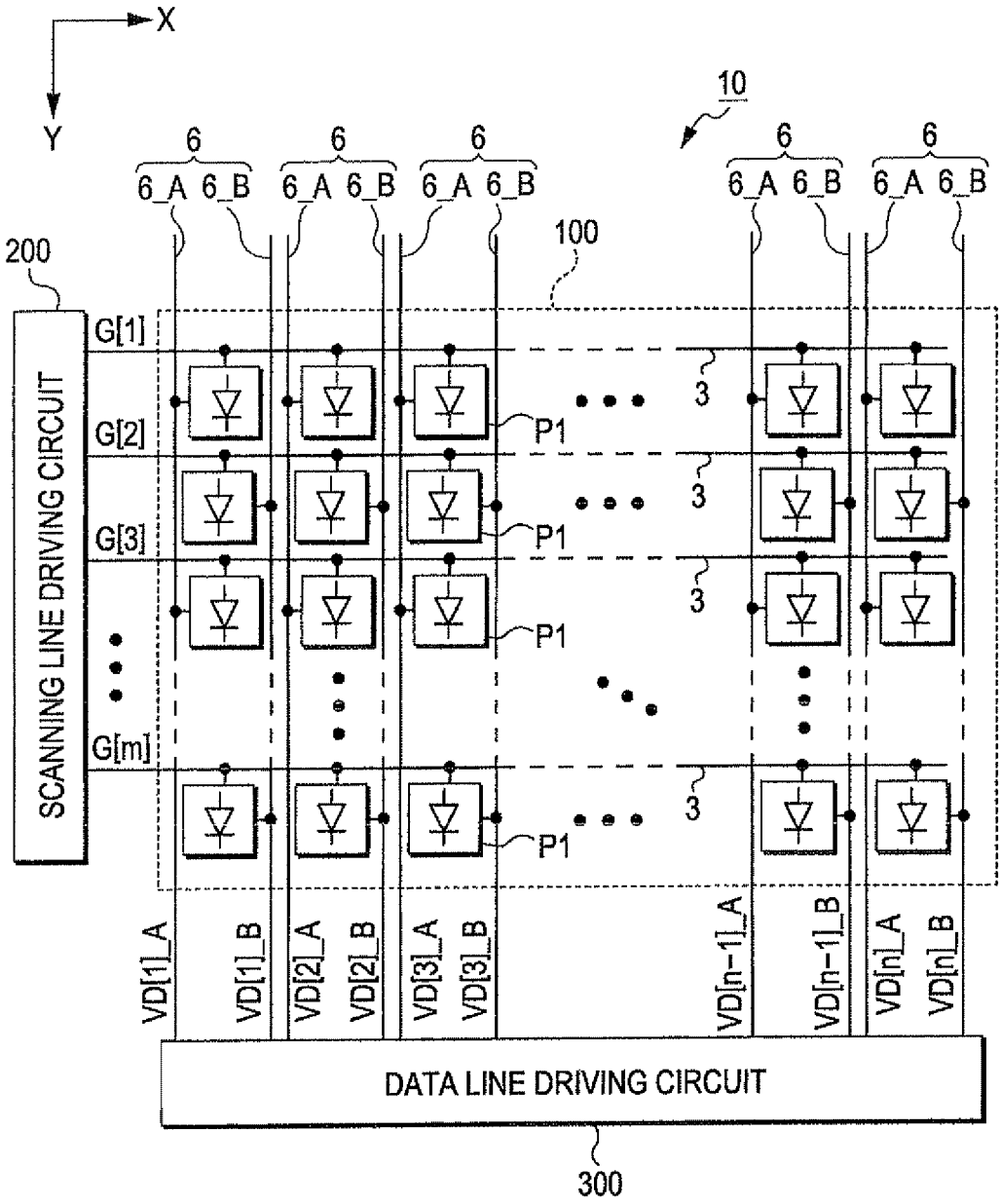
FIG. 1 is a block diagram illustrating an electro-optical apparatus according to a first embodiment of the present invention.

In FIG. 1, an electro-optical apparatus 10 is an apparatus which is applied to a variety of electronic devices for displaying images, and includes a pixel array unit 100 in which a plurality of unit circuits P1 is arranged in a planar shape, a scanning line driving circuit 200 and a data line driving circuit 300. In FIG. 1, the scanning line driving circuit 200 and the data line driving circuit 300 are illustrated as separate circuits, but a part or all of these circuits may be configured as a single circuit.

As shown in FIG. 1, m scanning lines 3 which are extended in an X direction and n data lines 6 which are extended in a Y direction perpendicular to the X direction are installed in the pixel array unit 100 (m and n are natural numbers). The respective unit circuits P1 are arranged in locations corresponding to intersections of the scanning lines 3 and the data lines 6. Accordingly, the unit circuits P1 are arranged in a matrix shape which is m rows long×n columns wide.

In the above configuration, the respective n data lines 6 includes a pair of, that is, two wirings 6_A and 6_B, as shown in FIG. 1. That is, if the number of the data lines 6 is n, the total number of the wirings 6_A and 6_B is 2n. Further, among the wirings 6_A and 6_B, the wirings 6_A are connected to the unit circuits P1 which are located in odd rows, and the wirings 6_B are connected to the unit circuits P1 which are located in even rows.

The scanning line driving circuit 200 in FIG. 1 is a circuit for selecting the plurality of unit circuits P1 in a row unit. The scanning line driving circuit 200 generates scanning signals G[1] to G[m] which are sequentially active and outputs the generated scanning signals G[1] to G[m] to the respective m scanning lines 3. Transition to an active state of the scanning signal G[i] which is supplied to the scanning line 3 of an i-th row (i is an integer satisfying $1 \leqq i \leqq m$) refers to selection of n unit circuits P1 which belongs to the i-th row.

The data line driving circuit 300 in FIG. 1 generates data electric potentials VD[1] to VD[n] corresponding to respective gradation data of the n unit circuits P1 for every row corresponding to the scanning lines 3 selected by the scanning line driving circuit 200, and outputs the generated data electric potentials VD[1] to VD[n] to the respective data lines 6. Hereinafter, the data electric potential VD which is output to the data line 6 of a j-th column (j is an integer satisfying $1 \leqq j \leqq n$) may be expressed as VD[j].

In this case, since each data line 6 includes two wirings 6_A and 6_B as described above, the data electric potentials VD[1] to VD[n] also correspond to the two wirings 6_A and 6_B. That is, for example, data electric potentials VD[1]_A and VD[1]_B are output corresponding to the wirings 6_A and 6_B included in the data line 6 of a first column, and data electric potentials VD[3]_A and VD[3]_B are output corresponding to the wirings 6_A and 6_B included in the data line 6 of a third column (see FIG. 1).

Figure 2:
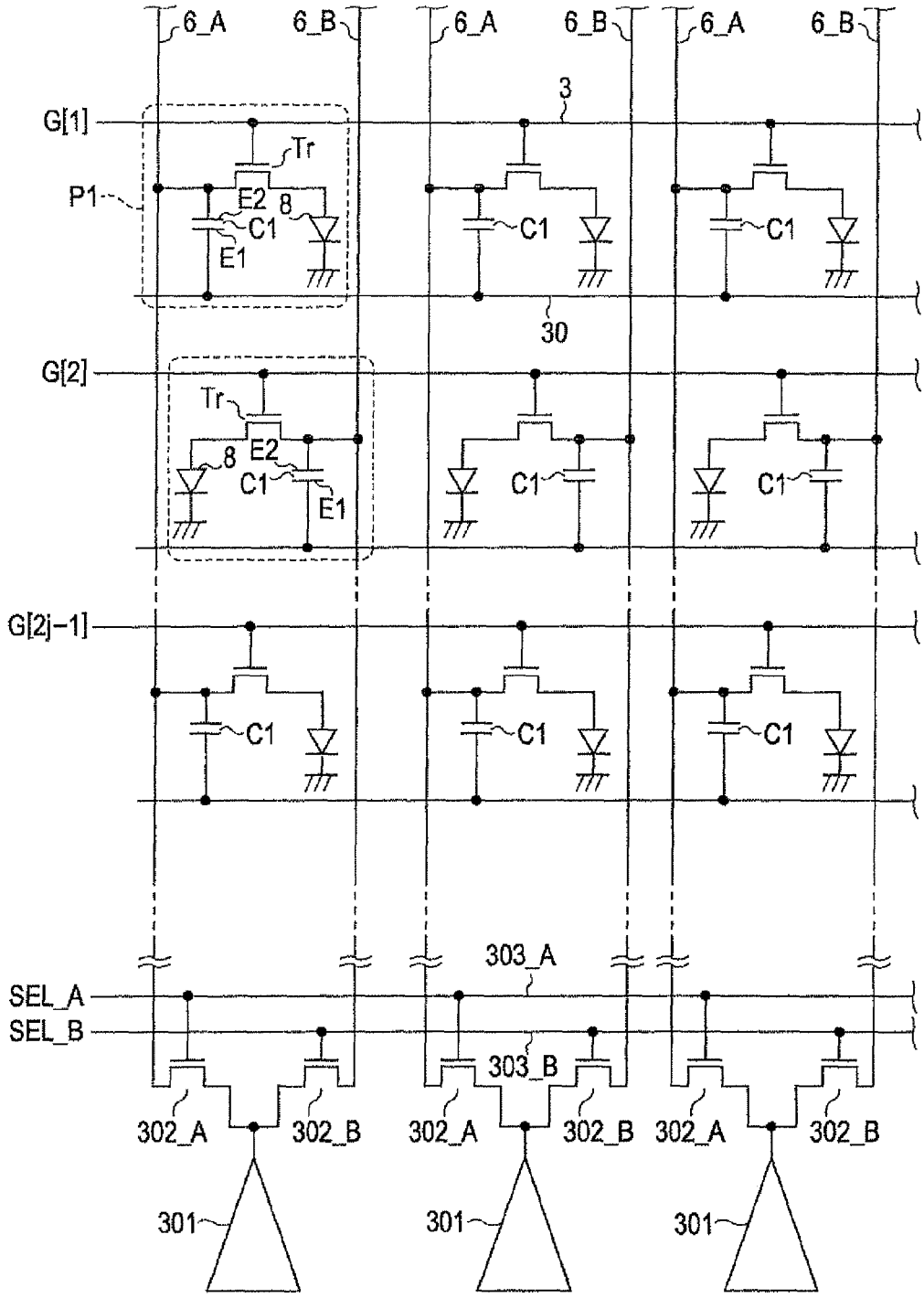
FIG. 2 is a circuit diagram illustrating details of unit circuits and data electric potential generating units for forming the electro-optical apparatus in FIG. 1.

For this purpose, as shown in FIG. 2, the data line driving circuit 300 includes data electric potential generating units 301 corresponding to the unit circuits P1 located in the respective columns, first and second switching transistors 302_A and 302_B, and switching transistor control wirings (hereinafter, referred to as "SW wirings") 303_A and 303_B which supply control signals to respective gates of the first and second switching transistors 302_A and 302_B.

One of the data electric potential generating units 301 is installed to correspond to every data line 6, or every pair of wirings 6_A and 6_B. The respective data electric potential generating units 301 generates data electric potential according to the data lines 6 to which the corresponding wirings 6_A and 6_B correspond. For example, the data electric potential generating units 301 of the wirings 6_A and 6_B corresponding to the first column data line 6 generate the data electric potential VD[1] (that is, VD [1]_A and VD[1]_B).

Further, control signals SEL_A and SEL_B are respectively output to the SW wirings 303_A and 303_B. The control signals SEL_A and SEL_B are appropriately synchronized with transition between the active state and non-active state of the respective scanning signals G[1] to G[m], respectively, and are transited between the active state and the non-active state in a similar way.

The respective first and second switching transistors 302_A and 302_B are N-channel types, and are switched on when the control signals SEL_A and SEL_B are in an active state. According to the transition between the conductive or non-conductive of the respective transistors (302_A and 302_B), the data electric potential VD[j]_A is output to the wiring 6_A, and the data electric potential VD[j]_B is output to the wiring 6_B.

Through the above configuration and connection relations of the unit circuits P1 and the wirings 6_A and 6_B, data electric potentials VD[1]_A, VD[2]_A, . . . , VD[n]_A indicated by a subscript A are supplied to the unit circuits P1 located in the odd rows. Similarly, data electric potentials VD[1]_B, VD[2]_B, . . . , VD[n]_B indicated by a subscript B are supplied to the unit circuits P1 located in the even rows.

Herein, a "switching unit" in the invention includes at least the first and second switching transistors 302_A and 302_B and the SW wirings 303_A and 303_B.

FIG. 2 is a circuit diagram illustrating a detailed electric configuration for the respective unit circuits P1.

Each unit circuit P1 includes an electro-optical element 8, a capacitor element C1 and a transistor Tr, as shown in FIG. 2.

The electro-optical element 8 is an OLED (Organic Light Emitting Diode) element in which a light emitting layer of an organic EL material is disposed between a positive electrode and a negative electrode, and is arranged between the transistor Tr and a constant electric potential line (grounding wire) to which a constant electric potential is supplied, as shown in FIG. 2. Here, the positive electrode is installed for every unit circuit P1 and is an individual electrode controlled for every unit circuit P1, and the negative electrode is a common electrode commonly installed in the unit circuit P1. In addition, the negative electrode is connected to the constant electric potential line to which the constant electric potential is supplied. Alternatively, the positive electrode may be the common electrode and the negative electrode may be the individual electrode.

The capacitor element C1 is an element for storing the data electric potential VD[j] supplied from the data line 6. As shown in FIG. 2, the capacitor element C1 includes a first electrode E1 connected to a capacitor line 30, and a second electrode E2 connected to the data line 6. Herein, in the case where the second electrode E2 is connected to the data line 6, the first embodiment has the following characteristics. That is, as shown in FIG. 2, the second electrode E2 of the capacitor element C1 included in the unit circuit P1 located in the odd row is connected to the wiring 6_A for forming the data line 6. Meanwhile, the second electrode E2 of the capacitor element C1 included in the unit circuit P1 located in the even row is connected to the wiring 6_B for forming the data line 6.

The capacitor line 30 to which a fixed electric potential is supplied is commonly connected to the respective unit circuits P1. Further, a ground electric potential is supplied to the constant electric potential line. For example, a negative electric potential may be supplied to the constant electric potential line. Further, the data electric potential VD[n] indicating the highest luminance among the data electric potentials VD[j] may be a positive electric potential, and the data electric potential VD[1] indicating the lowest luminance among the data electric potential VD[j] may be a negative electric potential. That is, the ground electric potential may be disposed between the data electric potential VD[n] and the data electric potential VD[1]. Thus, amplitude of the data electric potential VD[j] with respect to the ground electric potential may be reduced and power consumption may be reduced.

The transistor Tr is an N-channel type and is a switching element which is switched on when selecting the scanning lines 3 so as to conduct between the second electrode E2 of the capacitor element C1 and the electro-optical element 8. As shown in FIG. 2, a source of the transistor Tr is connected to the positive electrode of the electro-optical element 8, and a drain thereof is connected to the second electrode E2 of the capacitor element C1. Accordingly, the drain of the transistor Tr is also connected to the wiring 6_A shown in the left side in the figure with respect to the unit circuit P1 located in the odd row, and is connected to the wiring 6_B shown in the right side in the figure with respect to the unit circuit P1 located in the even row, similarly to the connection state with respect to the second electrode E2.

In addition, a gate of the transistor Tr is connected to the scanning line 3. Thus, if the scanning signal G[i] is transited to the active state, the transistor Tr is in an on state, to thereby conduct between the second electrode E2 and the electro-optical element 8. Meanwhile, if the scanning signal G[i] is transited to the non-active state, the transistor Tr is in an off state, to thereby cut off conduction between the second electrode E2 and the electro-optical element 8.

Next, an operation or action of the electro-optical apparatus 10 according to the first embodiment will be described with reference to FIGS. 3 to 5, in addition to FIGS. 1 and 2. A period 1H shown in FIG. 3 refers to time which is allocated for driving the unit circuit P1 for every row, that is, one horizontal scanning period.

The electro-optical apparatus 10 is based on the following operations "i" and "ii".

i. Writing Operation

The writing operation is an operation that the data electric potential VD[j] corresponding to light emitting gradation of the electro-optical element 8 included in the unit circuit P1 located in a certain row is stored in the capacitor elements C1 in the unit circuits P1 which belongs to a column including the electro-optical element 8. For example, the data electric potential VD[3]_B for the electro-optical apparatus 8 located in the second row and the third column (see FIG. 1) is stored in the plurality of capacitor elements C1 in the respective unit circuits P1 located in the third column. In this case, it should be noted that the capacitor element C1 used for storage of the data electric potential VD[3]_B is included in only each unit circuit P1 located in the even row.

ii. Light Emitting Operation (Driving Of Electro-Optical Element)

The light emitting operation is an operation that the electro-optical element 8 emits light on the basis of the data electric potential VD[j] stored in the capacitor element C1 in "i". The operation includes an operation in which the unit circuit P1 including the electro-optical element 8 supplies the scanning signal G[i] which is active to the corresponding scanning line 3, to thereby turn on the transistor Tr in the unit circuit P1. Thus, the electro-optical element 8 is supplied with electric current corresponding to electric charges stored in the capacitor element C1 to emit light.

The electro-optical apparatus 10 according to the first embodiment basically operates on the basis of an appropriate combination of the above described "i" and "ii" operations, which will be described in more detail hereinafter.

Figure 3:
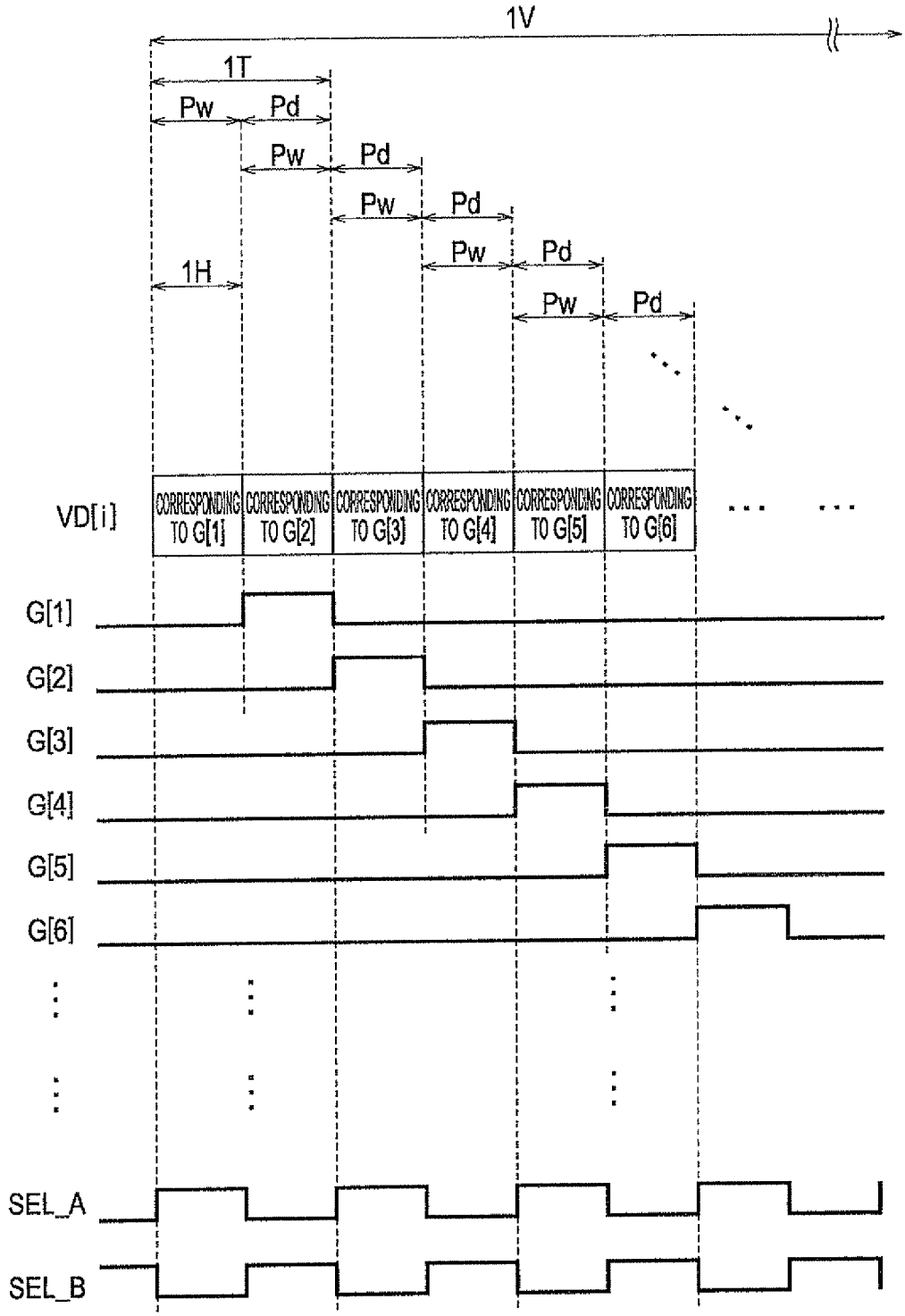
FIG. 3 is a timing chart for illustrating an operation of the electro-optical apparatus in FIGS. 1 and 2.

Firstly, in a writing period Pw shown in the leftmost side in FIG. 3, the active control signal SEL_A is supplied to the SW wiring 303_A in the data line driving circuit 300, and the non-active control signal SEL_B is supplied to the SW wiring 303_B, and thus, the first switching transistor 302_A is in the on state and the second switching transistor 302_B is in the off state. Further, the data electric potential generating unit 301 generates the data electric potentials VD[1]_A, VD[2]_A, . . . , VD[n]_A indicated by the subscript A and supplies the generated data electric potentials VD[1]_A, VD[2]_A, . . . , VD[n]_A to the wirings 6_A included in the respective data lines 6. The data electric potential VD[j]_A corresponds to the electro-optical element 8 in each unit circuit P1 located in the first row (see "corresponding to G[1]" in FIG. 3).

In this way, the "i. Writing operation" is completed with respect to the electro-optical element 8 in each unit circuit P1 located in the first row. In this case, through connection states between the above described wirings 6_A and 6_B and the unit circuits P1, for example, the data electric potential VD[1]_A corresponding to the electro-optical element 8 in the first row and the first column is stored in the capacitor elements C1 in the respective unit circuits P1 which are included in the first column and are located in the odd rows.

Next, in a driving period Pd adjacent to the writing period Pw, the scanning line driving circuit 200 supplies the active scanning signal G[1] to the first row scanning line 3. Thus, the electro-optical elements 8 which belong to the first row concurrently emit light (the "ii. Light emitting operation"). At this time, electric current flowing through the electro-optical elements 8 correspond to the amount of electric charges stored in the capacitor elements C1 which belong to the odd rows. Thus, one unit period 1T is terminated (see an upper side in FIG. 3).

Further, in the first embodiment, the "i. Writing operation" with respect to the electro-optical element 8 in each unit circuit P1 located in the second row is also performed. In this case, the principle of the operation is not different from that of the writing operation with respect to the first row. However, opposite to the previous case, the control signal SEL_A is non-active and the control signal SEL_B is active, and thus, the first switching transistor 302_A is in the off state and the second switching transistor 302_B is in the on state. In addition, the data electric potential generating unit 301 generates the data electric potentials VD[1]_B, VD[2]_B, . . . , VD[n]_B indicated by the subscript B and supplies the generated data electric potentials VD[1]_B, VD[2]_B, . . . , VD[n]_B to the wirings 6_B (see "corresponding to G[2]" in FIG. 3). Thus, for example, the data electric potential VD[1]_B corresponding to the electro-optical element 8 in the second row and the first column is stored in the capacitor elements C1 of the respective unit circuits P1 which are included in the first column and are located in the even rows.

Figure 4:
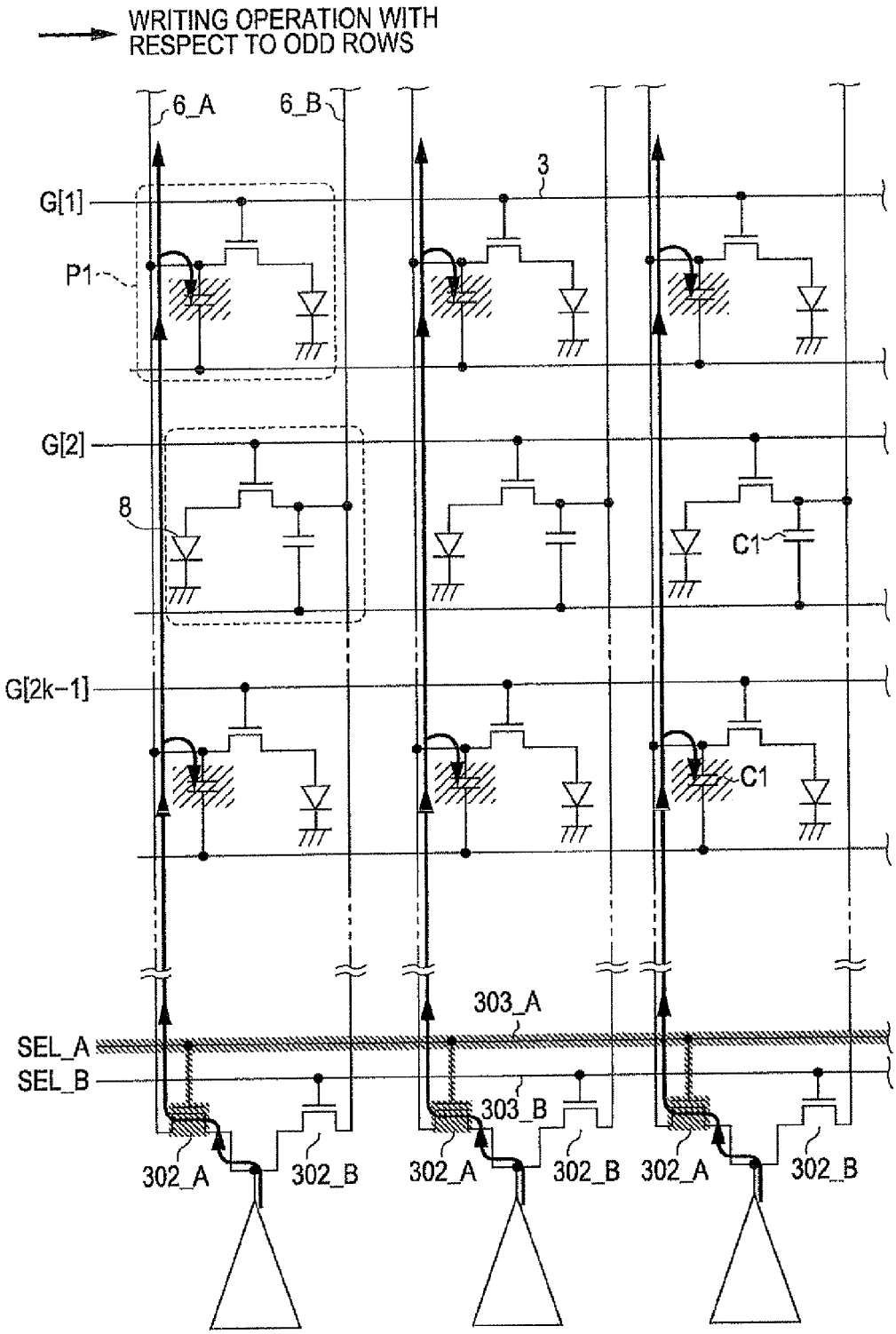
FIG. 4 is a diagram illustrating charging and discharging of a capacitor element (C1) in the electro-optical apparatus which is operated according to FIG. 3.
Figure 5:
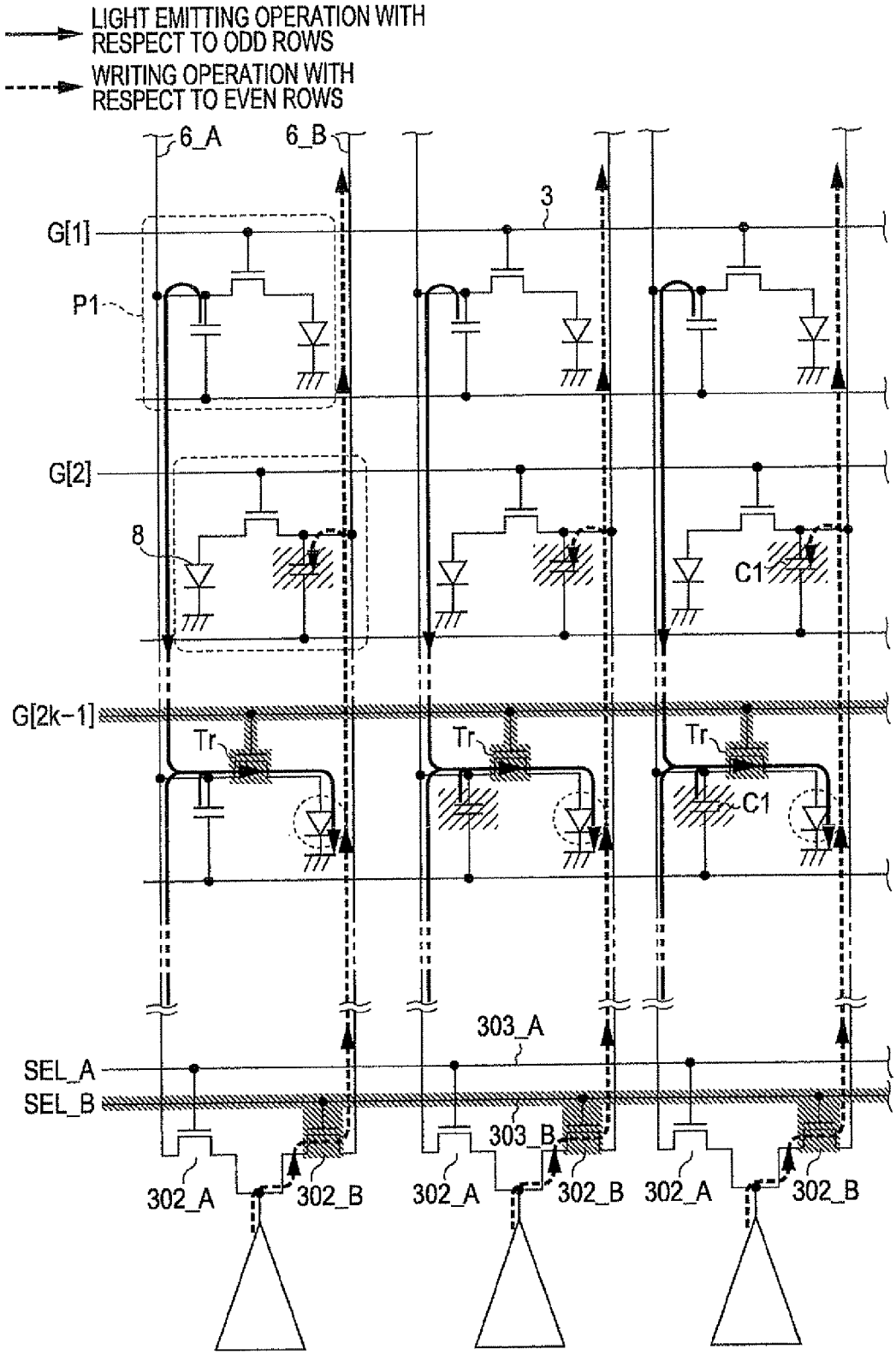
FIG. 5 is another diagram illustrating charging and discharging of the capacitor element (C1) in the electro-optical apparatus which is operated according to FIG. 3.

FIGS. 4 and 5 illustrate the above operations. Here, FIG. 4 illustrates a case that the control signal SEL_A is active and the first switching transistor 302_A is turned on, and thus, the capacitor elements C1 which belong to $(2k-1)$th rows (k is an appropriate integer), that is, the odd rows, stores therein electric charges corresponding to the data electric potential VD[j]_A (see thick arrows, solid arrows, shaded sections relating to the arrows, and the like in FIG. 4).

FIG. 5 illustrates a case that the active scanning signal G[$2k-1$] is supplied to the scanning line 3 corresponding to the $(2k-1)$th row, and thus, the transistors Tr which belong to the row are turned on and the respective electro-optical elements 8 corresponding to the transistors Tr emit light. Further, in this case, electric current is supplied to the electro-optical element 8 according to the electric charges of the capacitor elements C1 which belong to the odd rows (see thick arrows, solid arrows, shaded sections relating to the arrows, and the like in FIG. 5).

Meanwhile, FIG. 5 also illustrates a case that the writing operation with respect to the electro-optical elements 8 in the unit circuits P1 located in the even rows including the second row is performed (see thick arrows, wave line arrows, shaded sections relating to the arrows, and the like in FIG. 5). Since the $(2k-1)$th row electro-optical elements 8 are a driving target in FIG. 5, thereafter, the electro-optical elements 8 of the $2k(=(2k-1)+1)$th rows are the driving target for light emitting (not shown).

Thereafter, the above described operations are repeatedly performed. That is, in a certain point of time, the writing operation with respect to the capacitor elements C1 which belong to the odd rows and the light emitting operation of the electro-optical elements 8 which belong to the even rows are performed, but in another point of time, while reverse operations thereof are performed, the electro-optical elements 8 which are the light emitting target are sequentially shifted downward in FIGS. 4 and 5 (or FIGS. 1 and 2).

A period 1V in FIG. 3 refers to one vertical scanning period which is a period until all scanning lines 3 are completely selected.

The electro-optical apparatus 10 according to the first embodiment which is configured to perform the above described operations has the following effects.

That is, according to the electro-optical apparatus 10 according to the first embodiment, since data line 6 includes two wirings 6_A and 6_B, and the wirings 6_A and 6_B are respectively connected to the unit circuits P1 located in the odd rows and the unit circuits P1 in the even rows, time for simultaneous charging or simultaneous discharging of the capacitor element C1 for driving the one electro-optical element 8 can be obtained for a relatively long time.

Figure 6:
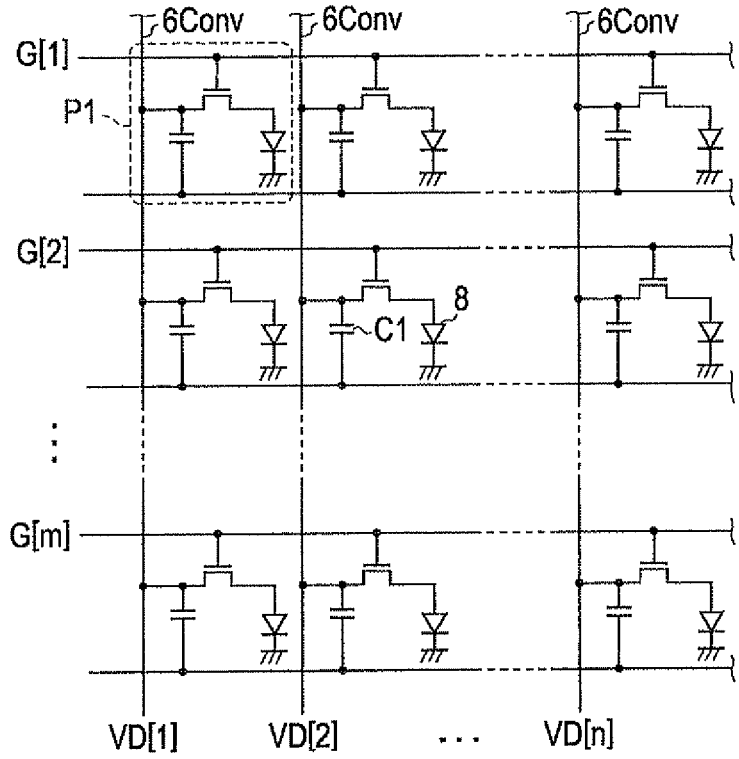
FIG. 6 is a diagram illustrating a configuration of a comparative example with respect to a configuration of the electro-optical apparatus according to the first embodiment.
Figure 7:
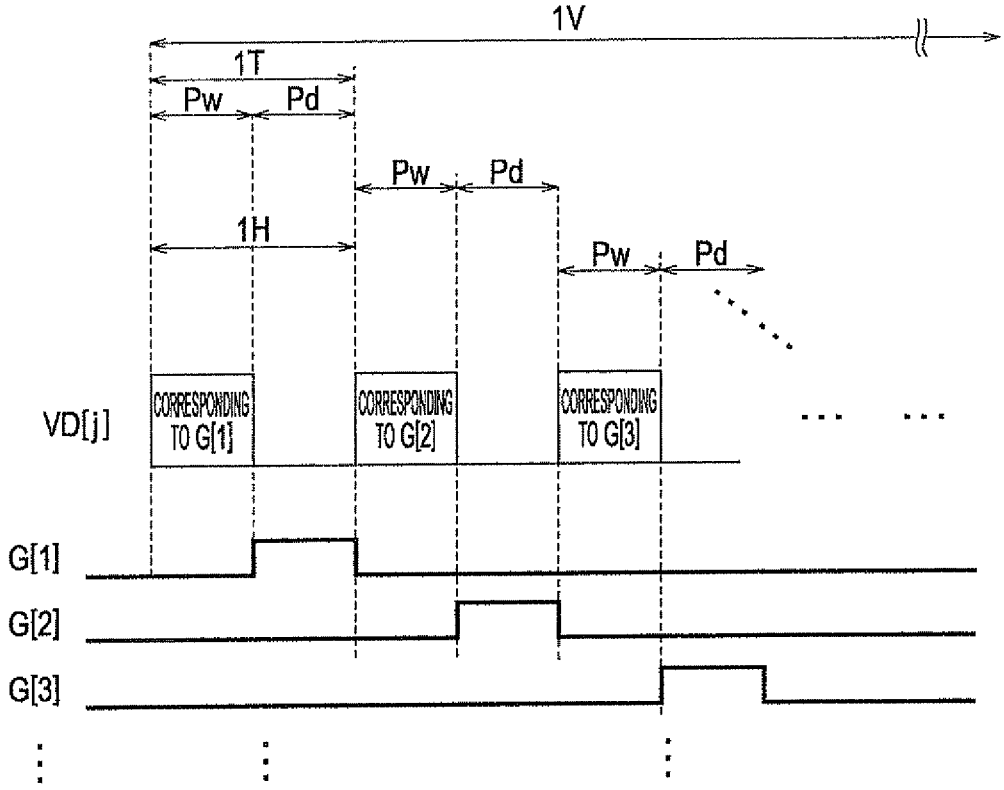
FIG. 7 is a timing chart for illustrating an operation of the configuration of the comparative example in FIG. 6.

This may be understood more clearly by comparing the first embodiment with FIGS. 6 and 7. FIG. 6 illustrates a comparative example with respect to the configuration according to the first embodiment (refer to FIG. 2), and FIG. 7 is a timing chart for an operation of a configuration of the comparative example in FIG. 6 (refer to FIG. 3).

In FIG. 6, differently from FIGS. 1 and 2, every data line 6Conv is installed corresponding to every column of unit circuits P1. In the first embodiment, each data line 6 corresponding to every column includes two wirings 6_A and 6_B, but in the comparative example, each data line 6Conv includes only one wiring. Accordingly, in FIG. 6, connection points of respective comparative elements C1 which belong to a certain column are focused on a certain data line 6Conv (see FIG. 6).

In FIG. 6, according to the above configuration, as shown in FIG. 7, a writing period Pw and a light emitting period Pd correctly alternate. That is, after a writing operation for electro-optical elements 8 which belong to the first row is performed, a light emitting operation of the electro-optical elements 8 is performed, and then a writing operation for electro-optical elements 8 which belong to the second row is performed. This means that concurrent processing of the writing operation and the light emitting operation (see FIGS. 5 and 3) cannot be performed in the comparative example.

According to the above configuration, if the lengths of the vertical scanning periods 1V shown in FIGS. 7 and 3 are the same, the length of every writing period Pw capable of being obtained in the case of FIG. 7 is shorter than that of the case of FIG. 3. This is also the case with the driving period Pd.

As apparent from the above comparison, according to the first embodiment, the writing period Pw and the driving period Pd can be maintained for a longer time compared with the comparative examples. Thus, in the first embodiment, since the concurrent charging in the capacitor element C1 is sufficiently performed and the concurrent discharging from the capacitor element C1 is sufficiently performed, the risk of luminance irregularity or the like in display images is significantly reduced.

Second Embodiment

Hereinafter, a second embodiment according to the invention will be described with reference to FIGS. 8 and 9. The second embodiment has a characteristic that data electric potential generating units for respective wirings 6_A and 6_B included in each data line 6 are provided. Other configurations and operations or actions of the second embodiment are the same as those of the first embodiment. Accordingly, hereinafter, the difference will be mainly described and other description will be appropriately simplified or omitted.

Figure 8:
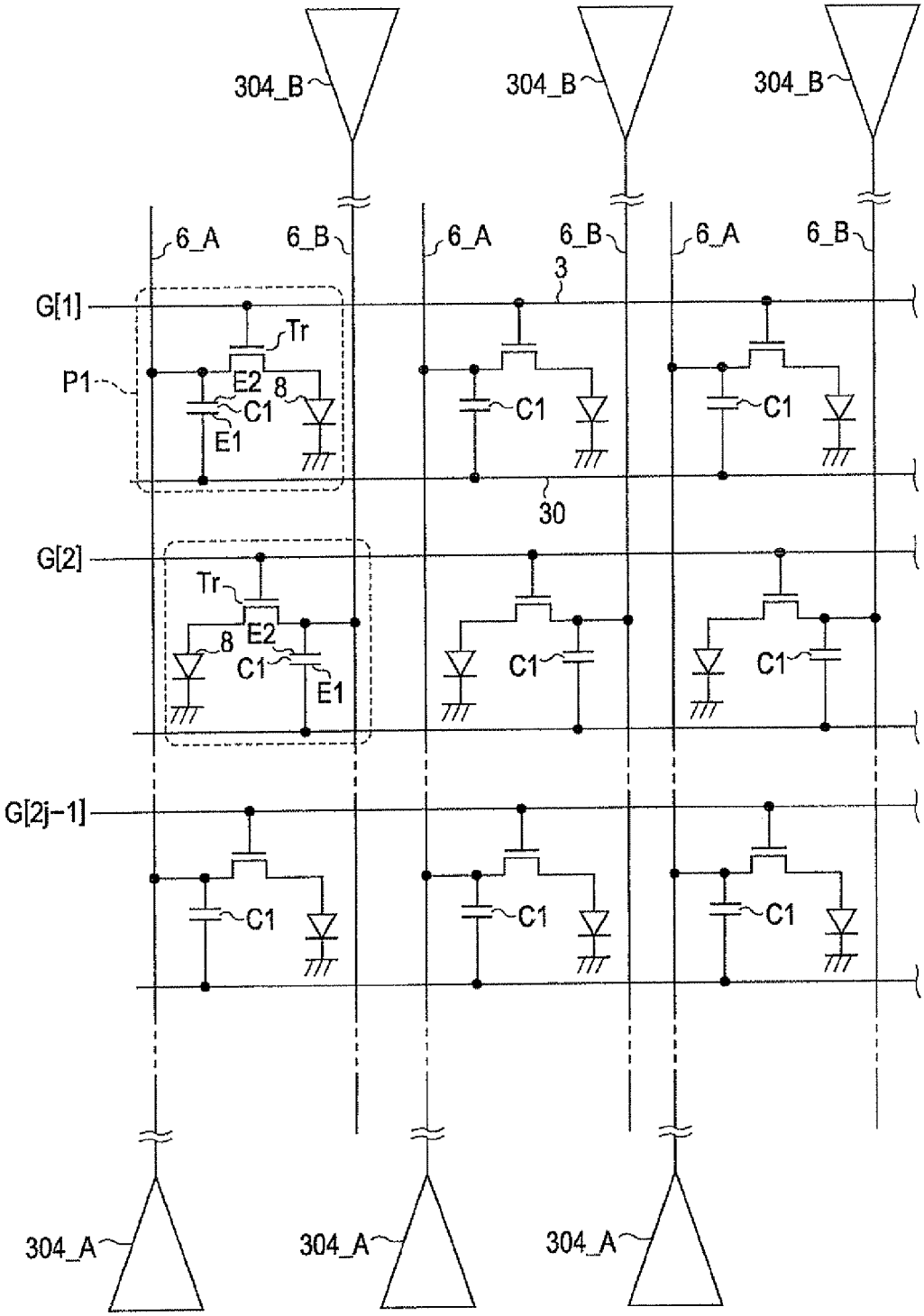
FIG. 8 is a circuit diagram illustrating details of unit circuits and data electric potential generating units for forming an electro-optical apparatus according to a second embodiment of the invention.

In the second embodiment, as shown in FIG. 8, a data line driving circuit 300 includes two sections which are separated up and down in the figure. That is, the data line driving circuit 300 includes a plurality of data electric potential generating units 304_A connected to the respective wirings 6_A in the lower side in FIG. 8, and a plurality of data electric potential generating units 304_B connected to respective wirings 6_B in the upper side in FIG. 8. Since the wiring 6_A is connected to the unit circuits P1 located in odd rows, similarly to the first embodiment, the data electric potential generating unit 304_A supplies a data electric potential VD[j]_A for the unit circuits P1 to the wiring 6_A. Similarly, since the wiring 6_B is connected to the unit circuits P1 located in even rows, the data electric potential generating unit 304_B supplies a data electric potential VD[j]_B for the unit circuits P1 to the wiring 6_B.

The data electric potential generating units 304_A and 304_B may independently generate the data electric potentials VD[j]_A and VD[j]_B, respectively, and may supply the generated data electric potentials VD[j]_A and VD[j]_B to the wirings 6_A and 6_B, respectively.

The plurality of data electric potential generating units 304_A and the plurality of data electric potential generating units 304_B respectively correspond to specific examples of "first data electric potential generating units" and "second data electric potential generating units" (or reversely) in the invention.

The electro-optical apparatus according to the second embodiment which has such a configuration operates or acts as follows. That is, firstly, in a writing period Pw shown in the leftmost side in FIG. 9, the data electric potential generating unit 304_A in the data line driving circuit 300 generates data electric potentials VD[1]_A, VD[2]_A, . . . , VD[n]_A and supplies the generated data electric potentials VD[1]_A, VD[2]_A, . . . , VD[n]_A to the wiring 6_A ("i. Writing operation"). The data electric potential VD[j]_A corresponds to an electro-optical element 8 in each unit circuit P1 located in a first row (see "corresponding to G[1]" in FIG. 9).

Next, in the second embodiment, in the writing period Pw, writing operation with respect to the electro-optical element 8 in each unit circuits P1 located in a second row is concurrently performed. That is, as shown in FIG. 9, at a point of time when approximately half of the writing period Pw with respect to the first row has been completed, a writing operation with respect to the second row starts (see "corresponding to G[2]" in FIG. 9). In this case, the principle of the operation is not different from that of the writing operation with respect to the above described first row. However, the data electric potential generating unit 304_B in the data line driving circuit 300 generates data electric potentials VD[1]_B, VD[2]_B, . . . , VD[n]_B and supplies the generated data electric potentials VD[1]_B, VD[2]_B, . . . , VD[n]_B to the wiring 6_B.

The above described operation can be performed according to the configuration that the data electric potential generating units 304_A and 304_B are individually provided according to the wirings 6_A and 6_B.

According to the above configuration, for example, the data electric potential VD[1]_A corresponding to the electro-optical element 8 in the first row and a first column is stored in the capacitor elements C1 of the respective unit circuits P1 which are included in the first column and are located in the odd rows, and the data electric potential VD[1]_B corresponding to the electro-optical element 8 of a second row and the first column is stored in the capacitor elements C1 of the respective unit circuits P1 which are included in the first column and are located in the even rows.

In a driving period Pd adjacent to the writing period Pw with respect to the first row, a scanning line driving circuit 200 supplies an active scanning signal G[1] to a scanning line 3 of the first row. Thus, the electro-optical elements 8 which belong to the first rows concurrently emit light ("ii. Light emitting operation"). At this time, electric current flowing through the electro-optical element 8 corresponds to the amount of electric charges stored in the capacity elements C1 which belong to the above described odd rows. In this way, one unit period 1T is terminated (see an upper side in FIG. 9).

In this case, a writing period Pw with respect to the second row is continued. That is, the light emitting operation with respect to the first row and the writing operation with respect to the second row are concurrently performed.

According to the configuration, there are three types of states which are that at a certain point of time, the writing operation with respect to the capacitor elements C1 which belong to the odd rows and the writing operation with respect to the capacitor elements C1 which belong to the even rows are concurrently performed, or at another certain point of time, the light emitting operation of the electro-optical elements 8 which belong to the odd rows and the writing operation with respect to the capacitor elements C1 which belong to the even rows are concurrently performed, or at still another point of time, the light emitting operation of the electro-optical elements 8 which belong to the even rows and the writing operation with respect to the capacitor element C1 which belong to the odd rows are concurrently performed. In the second embodiment, these three types of states are repeatedly performed in an appropriate order, and thus, the electro-optical elements 8 which are light emitting targets are sequentially shifted downward in FIG. 8.

It is obvious that the second embodiment as described above has a function effect which is not essentially different from that of the first embodiment.

Further, according to the second embodiment, since the data electric potential generating units 304_A and 304_B corresponding to the wirings 6_A and 6_B are provided, the writing operation with respect to the capacitor elements C1 which belong to the odd rows and the even rows may be concurrently performed, as described above. That is, as compared with the first embodiment in which the writing operation with respect to the odd rows and the light emitting operation with respect to the even rows (or reversely) are concurrently performed, in the second embodiment, time usage efficiency may be further enhanced. Thus, time for concurrent charging and concurrent discharging of the capacitor element C1 for driving one electro-optical element 8 may be more effectively lengthened as compared with the first embodiment.

Accordingly, the second embodiment may have the function effect which is more remarkable than the first embodiment.

In addition, in the second embodiment, as understood by comparing FIG. 8 and FIG. 2, it is not necessary to install the first and second switching transistors 302_A and 302_B and the SW wirings 303_A and 303_B which are installed in the first embodiment. Accordingly, according to the second embodiment, a reduction in the cost for installation thereof may be expected, and control of the first and second switching transistors 302_A and 302_B through the SW wirings 303_A and 303_B or the like is not required, thereby realizing simplicity of operation sequences.

Figure 9:
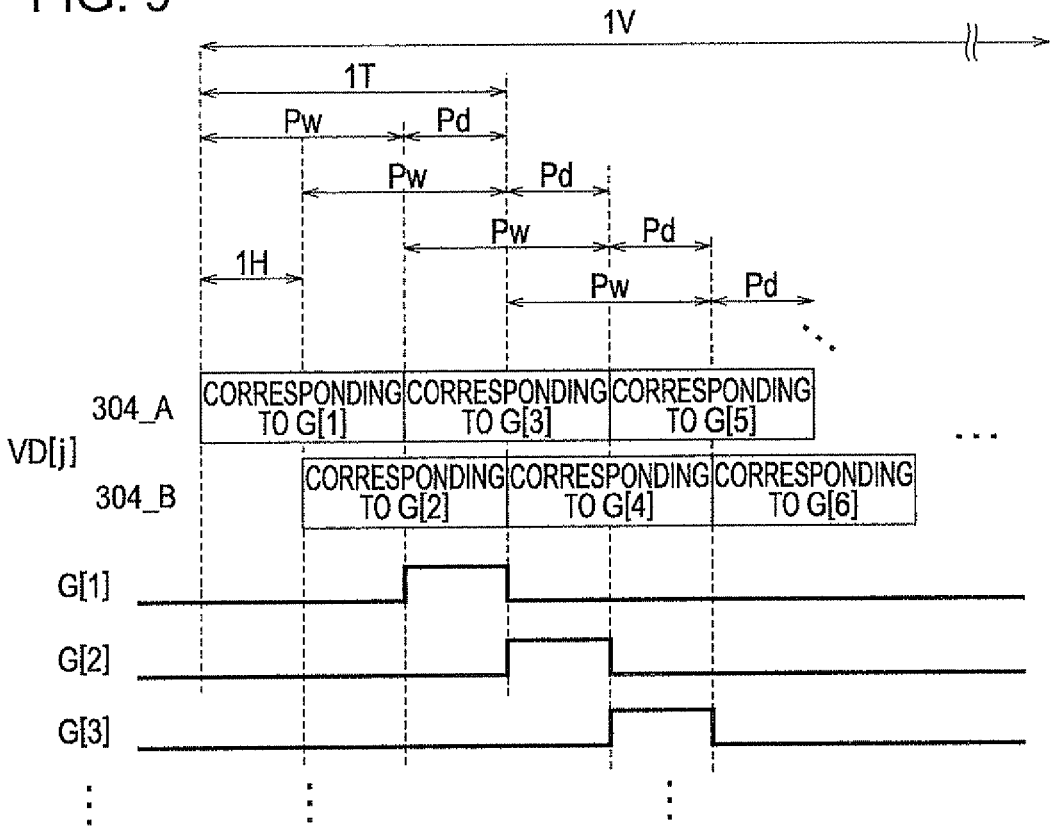
FIG. 9 is a timing chart for illustrating an operation of the electro-optical apparatus in FIG. 8.

In the above description, the process of operating the configuration shown in FIG. 8 according to the timing chart shown in FIG. 9 is described, but the configuration may be operated by other methods.

Figure 10:
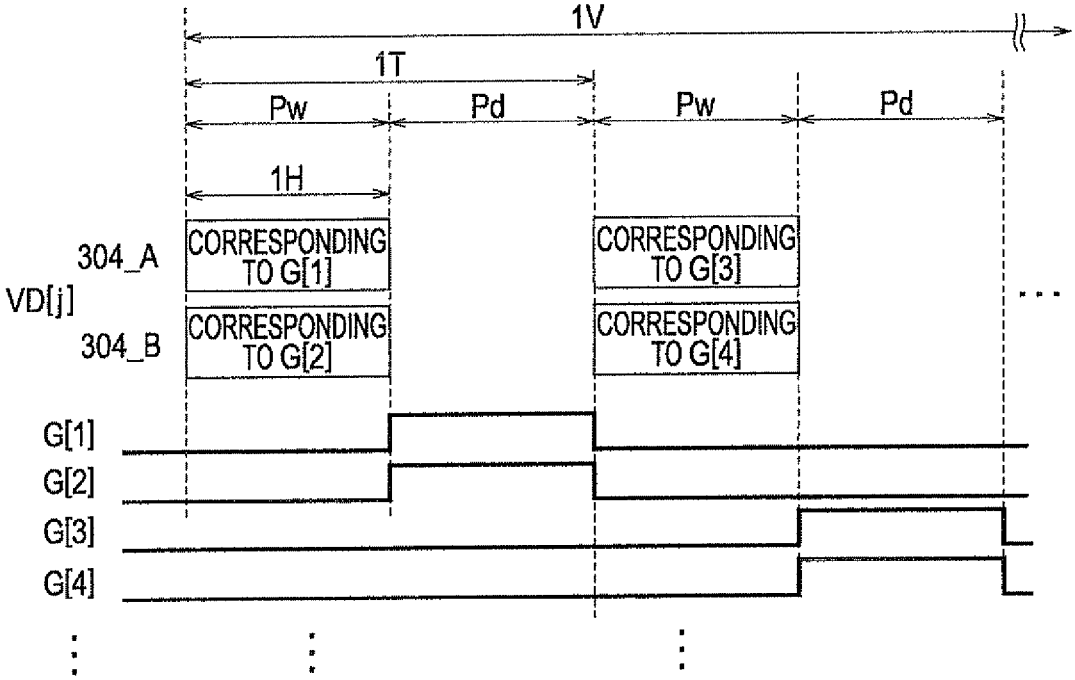
FIG. 10 is another timing chart for illustrating an operation of the electro-optical apparatus in FIG. 8.

For example, the configuration shown in FIG. 8 may be operated according to a timing chart shown in FIG. 10. In FIG. 10, firstly, in a writing period Pw shown in the leftmost side in FIG. 10, the data electric potential generating units 304_A and 304_B in the data line driving circuit 300 are simultaneously operated. That is, the data electric potential generating unit 304_A supplies the data electric potentials VD[1]_A, VD[2]_A, . . . , VD[n]_A to the wiring 6_A, and the data electric potential generating unit 304_B supplies the data electric potentials VD[1]_B, VD[2]_B, . . . , VD[n]_B to the wiring 6_B. Accordingly, the "i. Writing operation" for the electro-optical elements 8 in the respective unit circuits P1 located in the first and second rows is concurrently performed (see "corresponding to G[1]" and "corresponding to G[2]" in FIG. 10). In FIG. 10, after the writing period Pw, the "ii. Light emitting operations" with respect to the electro-optical elements 8 corresponding to the first and second rows are concurrently performed. Thereafter, the above operations are repeated (see FIG. 10).

The above described operational process does not seem to be different from the case in FIG. 7 which is referred to as the comparative example in the first embodiment, but in the case in FIG. 10, since the writing operation and the light emitting operation corresponding to two rows may be concurrently performed, time for the concurrent charging and the concurrent discharging of the capacitor elements C1 may be effectively lengthened. In reality, if the lengths of the vertical scanning periods 1V shown in FIG. 10 and FIG. 7 are the same, the length of each writing period Pw capable of being obtained in the case in FIG. 10 becomes twice of the case in FIG. 7. This is also the case with the driving period Pd.

Figure 11:
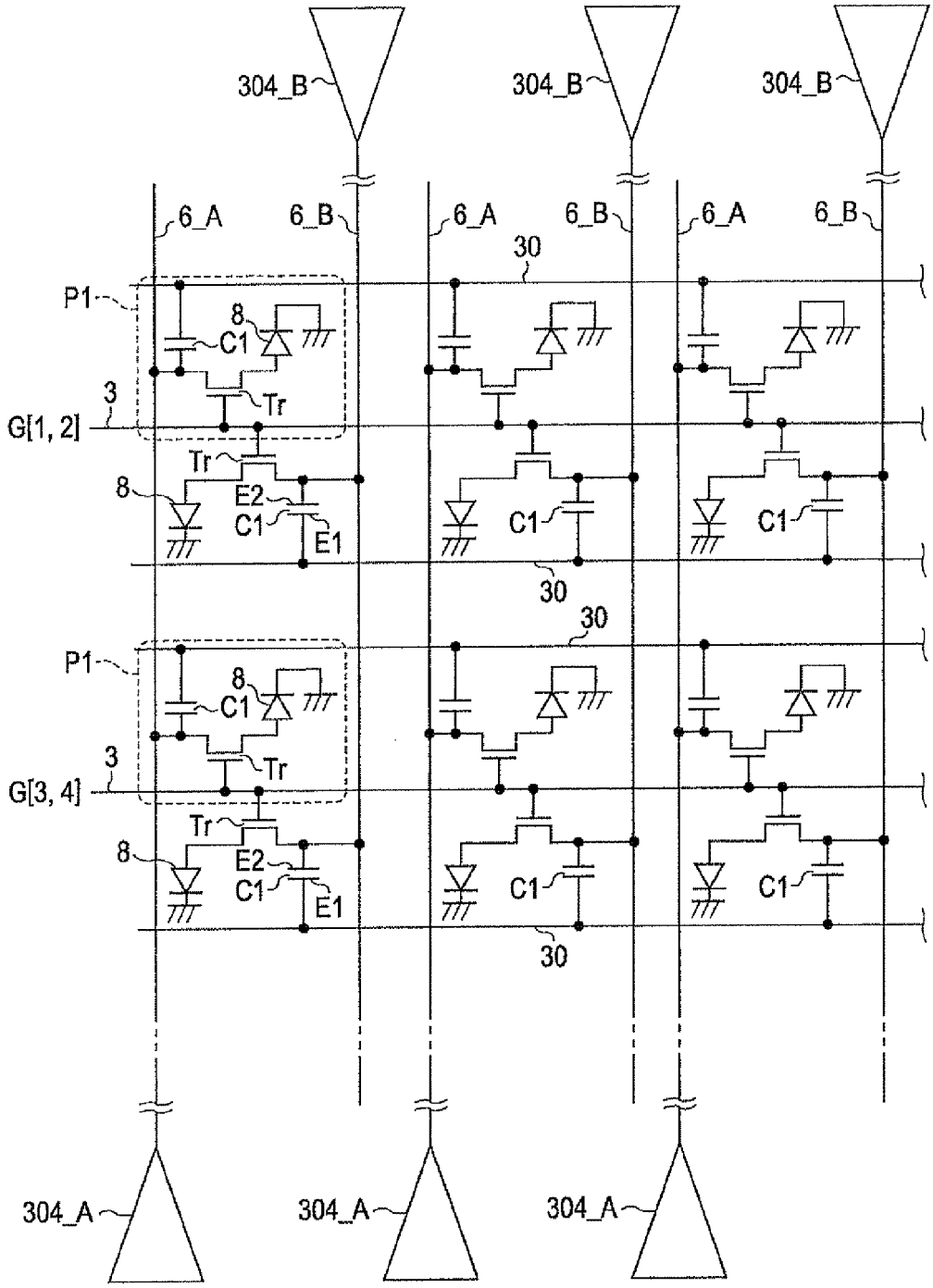
FIG. 11 is a circuit diagram illustrating details of unit circuits and data electric potential generating units for forming the electro-optical apparatus according to a modified example of the second embodiment of the invention.

In the case where the driving method as shown in FIG. 10 is applied to, it is not necessary to install the scanning line 3 corresponding to two adjacent unit circuits P1 along a column direction. That is, with respect to the unit circuits P1, one common scanning line 3 may be used. FIG. 11 illustrates a configuration example in such a case. Herein, the scanning line 3 in an upper side in the figure is common to the unit circuits P1 located in the first row and the second row (a reference number "G[1,2]" given to the scanning line 3 means that the common scanning signal G[1,2] is supplied to the unit circuits P1 (the scanning line 3)). Similarly, the scanning line 3 right under thereof is common to the unit circuits P1 located in a third row and a fourth row (see a reference number "G[3,4]").

The embodiments according to the invention are described hereinbefore, but the electro-optical apparatus according to the invention is not limited the above described embodiments, may have a variety of modifications.

(1) In the first and second embodiments, the charging target in the above described "i. Writing operation" is the capacitor element C1 included in the unit circuit P1, but the invention is not limited thereto.

Figure 12:
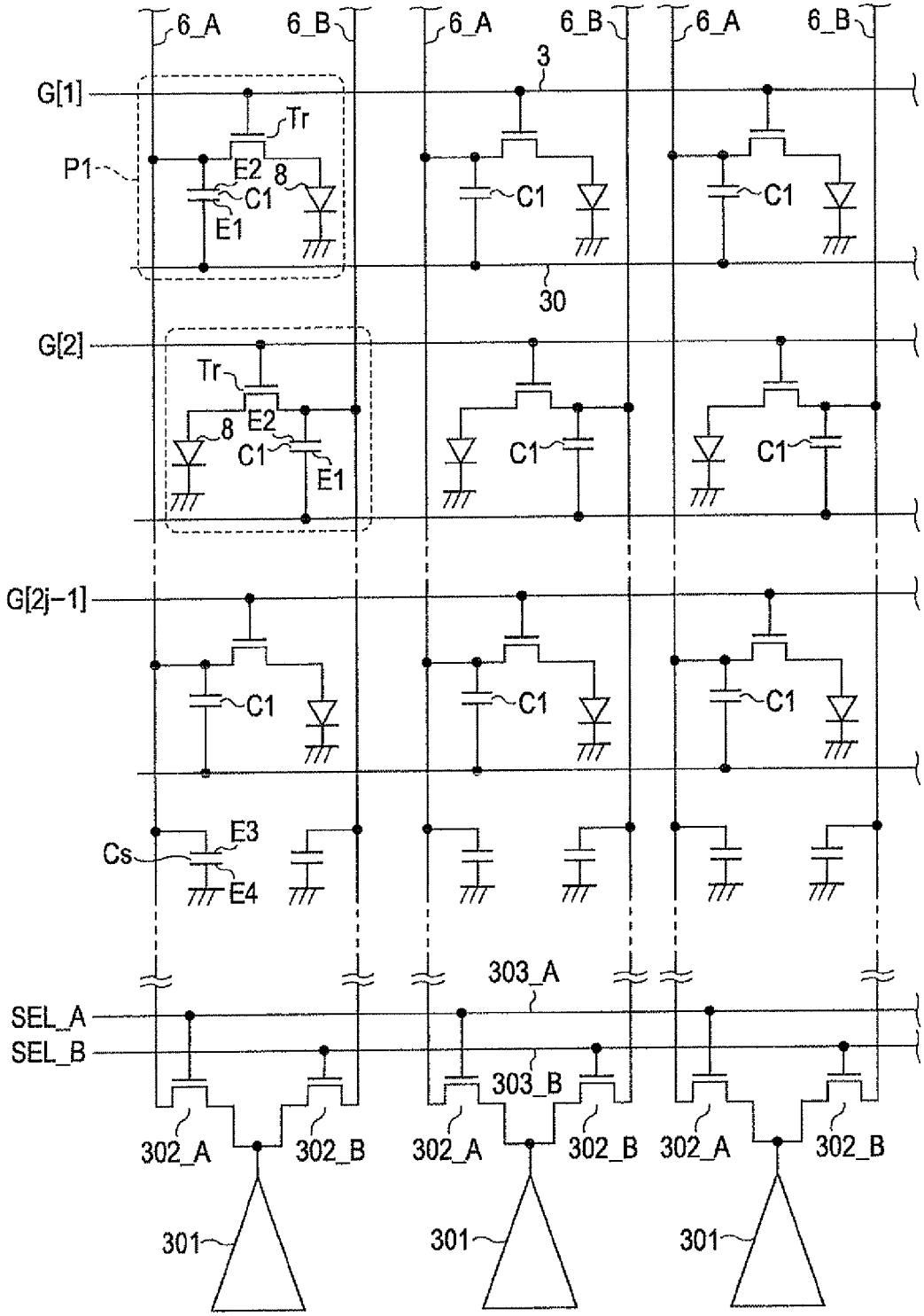
FIG. 12 is a circuit diagram illustrating details of unit circuits and data electric potential generating units for forming a modified example (addition of an auxiliary capacitor element) of the electro-optical apparatus according to the first and second embodiments of the invention.

For example, as shown in FIG. 12, an auxiliary capacitor element Cs may be connected to the respective wirings 6_A and 6_B. The capacitor element Cs has one electrode E3 connected to the wirings 6_A and 6_B, and the other electrode E4 connected to an electric potential line which is supplied with a fixed electric potential. FIG. 12 illustrates an example in which the capacitor element Cs is added to the configuration in FIG. 2 on the basis of the first embodiment, but the capacitor element Cs may be added on the basis of the second embodiment in FIG. 8.

In such a modification, in the writing period Pw in each unit period 1T shown in FIG. 3, FIG. 9 or FIG. 10, the auxiliary capacitor element Cs is charged in addition to the predetermined comparative element C1. Further, in the driving period Pd in each unit period 1T as shown FIG. 3, FIG. 9 or FIG. 10, electric charges from the auxiliary capacitor element Cs are supplied to the unit circuits P1 corresponding to the auxiliary capacitor element Cs.

According to such a modification, even in the case where the total value of capacitance of the capacitor element C1 connected to the wiring 6_A or 6_B corresponding to one electro-optical element 8 is insufficient for obtaining a sufficient light emitting amount of the electro-optical element 8, the capacitance of the auxiliary capacitor element Cs is used, to thereby compensate the insufficient capacitance.

The above described effect is especially meaningful in the first and second embodiments. In the first and second embodiments, since the "i. Writing operation" and the "ii. Light emitting operation" are not performed using the capacitor elements C1 in all the unit circuits P1, but using half of the capacitor element C1, the above described insufficient capacitance may be highly generated.

(2) In the first and second embodiments, the capacitor element C1 is included in the unit circuit P1, but the invention is not limited thereto.

Figure 13:
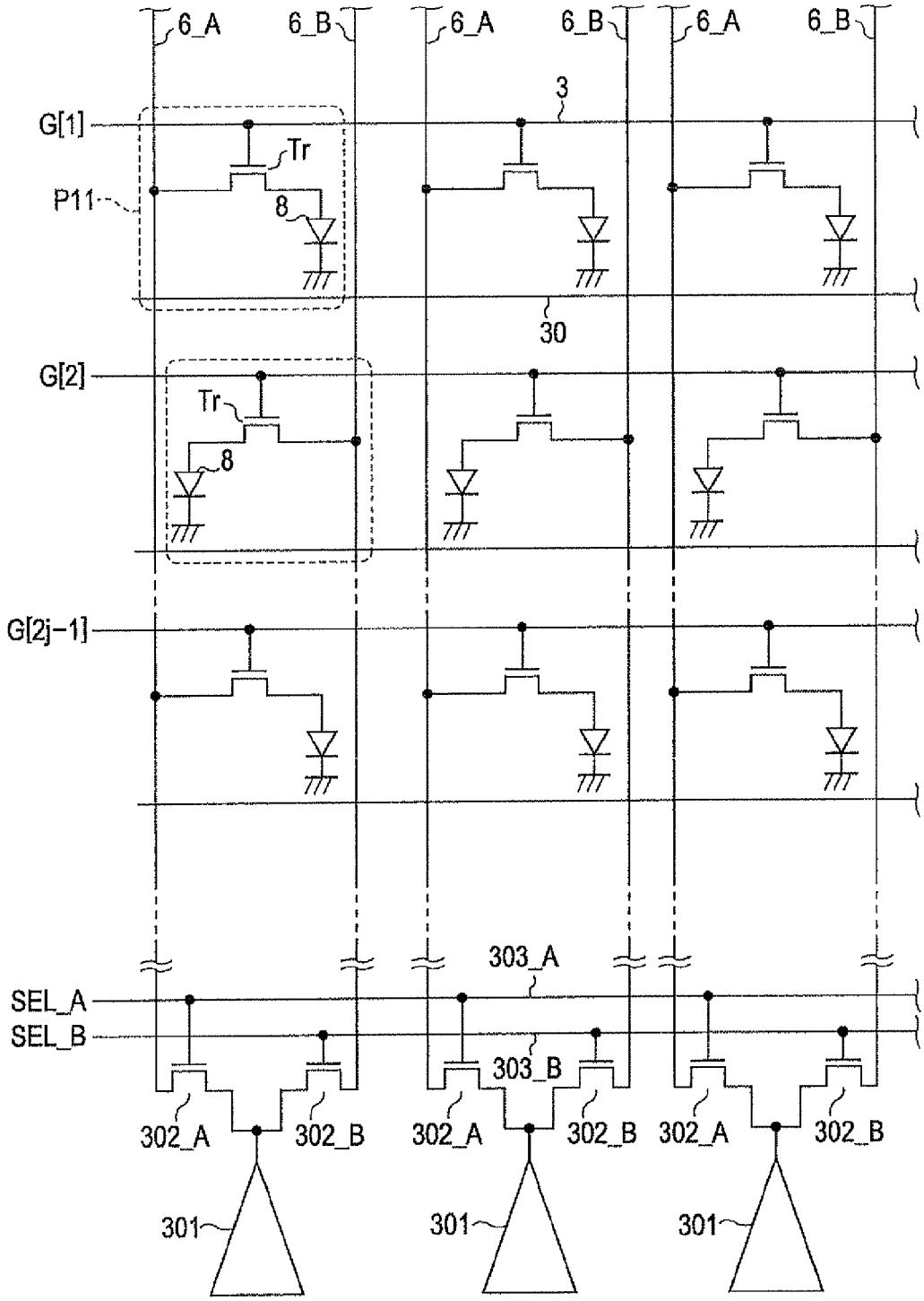
FIG. 13 is a circuit diagram illustrating details of unit circuits and data electric potential generating units for forming a modified example (non-existence of a capacitor element) of the electro-optical apparatus according to the first and second embodiments of the invention.

For example, as shown in FIG. 13, a unit circuit P11 may not include the capacitor element C1 in each embodiment. In this case, electric charges corresponding to the data electric potential VD[j] are stored in capacitance associated with each wiring 6_A or 6_B, that is, for example, in parasitic capacitance which parasitizes between the wiring 6_A or 6_B and a positive electrode of the electro-optical elements 8, or the like.

According to such a modification, a reduction in costs can be achieved which are equal to the cost for installation of the above described capacitor element C1. Further, since reduction in size of the unit circuit P11 may be realized, high definition can be achieved.

The auxiliary capacitor element Cs as described with reference to FIG. 12 may be added to the modification in FIG. 13, which is included in the range of the invention.

(3) In the first and second embodiments, the data line 6 includes two wirings 6_A and 6_B, but the invention is not limited with respect to the number of the wirings included in one data line 6. That is, each data line 6 may include three wirings or more.

Figure 14:
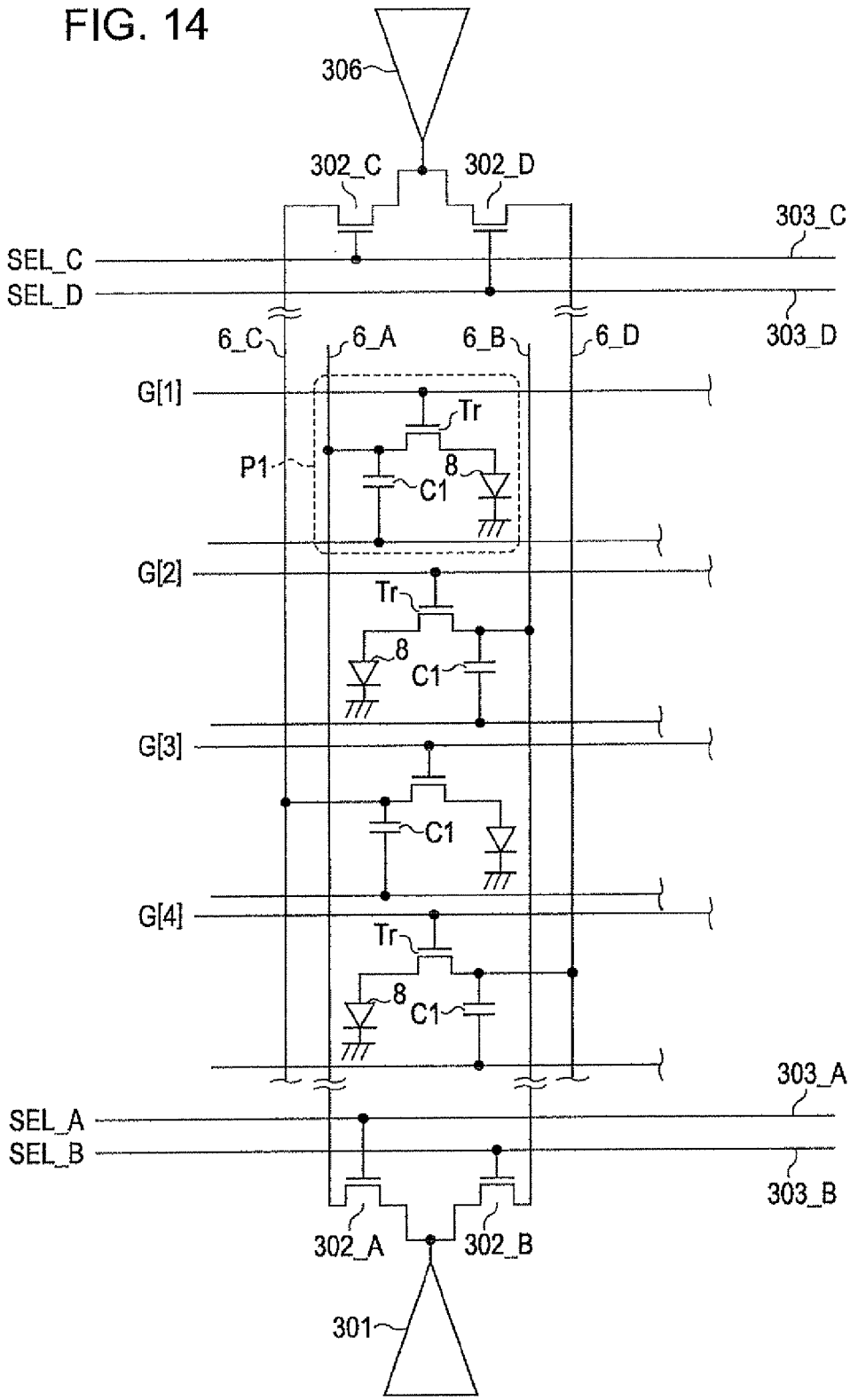
FIG. 14 is a circuit diagram illustrating details of the unit circuit and data electric potential generating unit for forming a modified example (increase in the number of wirings) of the electro-optical apparatus according to the first and second embodiments of the invention.

For example, as shown in FIG. 14, one data line 6 may include four wirings 6_A, 6_B, 6_C and 6_D. In the figure, the wirings 6_A and 6_B, and the data electric potential generating unit 301 and the first and second switching transistors 302_A and 302_B for supplying the data electric potential VD[j] to the wirings 6_A and 6_B are not different from the first embodiment.

In addition to the above configuration, as shown in FIG. 14, the wiring 6_C is connected to one electrode of a capacitor element C1 included in the third unit circuit P1 from the top in the figure, and the wiring 6_D is connected to the one electrode of a capacitor elements C1 included in the fourth unit circuit P1 from the top. Further, the third and fourth switching transistors 302_C and 302_D are respectively connected to the wirings 6_C and 6_D. Transition between an on state and an off state of the third and fourth switching transistors 302_C and 302_D is controlled by control signals SEL_C and SEL_D which are supplied to SW wirings 303_C and 303_D connected to gates thereof. In addition, a data electric potential generating unit 306 is connected to the third and fourth switching transistors 302_C and 302_D.

As it is obviously understood that the configurations of the data electric potential generating unit 306, the third and fourth switching transistors 302_C and 302_D, the SW wirings 303_C and 303_D, and the wirings 6_C and 6_D are parallel with the configurations of the data electric potential generating unit 301 and the like, its operations or functions are not essentially different from those of the configurations including the data electric potential generating unit 301 and the like. That is, a data electric potential VD[j]_C is supplied to the wiring 6_C through the third switching transistor 302_C at a certain point of time, and a data electric potential VD[j]_D is supplied to the wiring 6_D through the fourth switching transistor 302_D at another point of time. In this case, a variety of modifications may be considered regarding the timings when the first to fourth switching transistors (302_A to 302_D) respectively are in the on state or the off state (see FIG. 3, FIG. 9 or FIG. 10).

According to such a modification, since the number of the capacitor elements C1 involved in one time of charging or discharging is decreased as compared with the first or second embodiment, time for the charging or discharging may be further lengthened.

As understood from FIG. 14, in order to install the wirings around the unit circuits P1 in a balanced manner, it is preferable that the number of the wirings is even. (This means a case that a half of the even number of wirings is arranged on the left side of the unit circuits P1, and another half thereof is arranged on the right side of the unit circuits P1. In the case where all the wirings are arranged in a concentrated manner on one side of the unit circuits P1, whether the number of the wirings is even or odd has little effect in view of a balanced layout.) Further, the invention does not limit an upper limit of the number of the wirings, but it is preferable to be limited to about ten as a maximum in consideration of relations such as an aperture ratio.

Application

An electronic device to which the electro-optical apparatus 10 according to the embodiments is applied will be described hereinafter.

Figure 15:
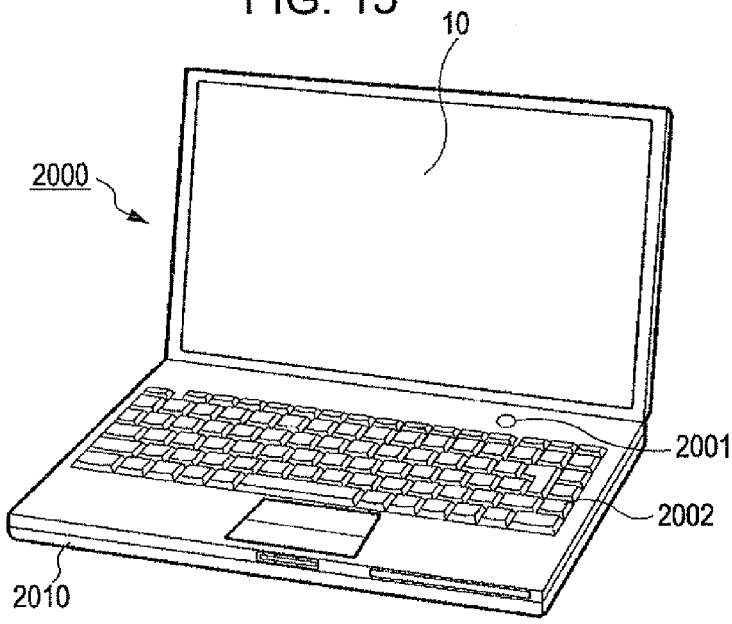
FIG. 15 is a perspective view illustrating an electronic device to which an electro-optical apparatus according to embodiments of the invention is applied.

FIG. 15 is a perspective view illustrating a configuration of a mobile personal computer in which the electro-optical apparatus 10 according to the embodiments is applied to an image display. A personal computer 2000 includes the electro-optical apparatus 10 which is a display apparatus, and a main body 2010. A power switch 2001 and a keyboard 2002 are installed in the main body 2010.

Figure 16:
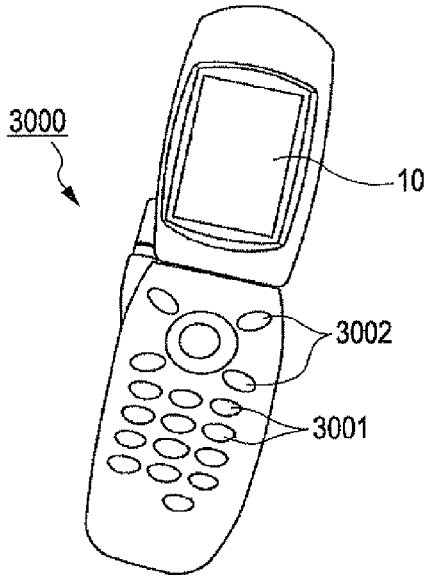
FIG. 16 is a perspective view illustrating another electronic device to which the electro-optical apparatus according to embodiments of the invention is applied.

FIG. 16 illustrates a cellular phone to which the electro-optical apparatus 10 according to the embodiments is applied. A cellular phone 3000 includes a plurality of manipulation buttons 3001, scroll buttons 3002, and the electro-optical apparatus 10 which is a display apparatus. By manipulating the scroll buttons 3002, a screen displayed in the electro-optical apparatus 10 is scrolled.

Figure 17:
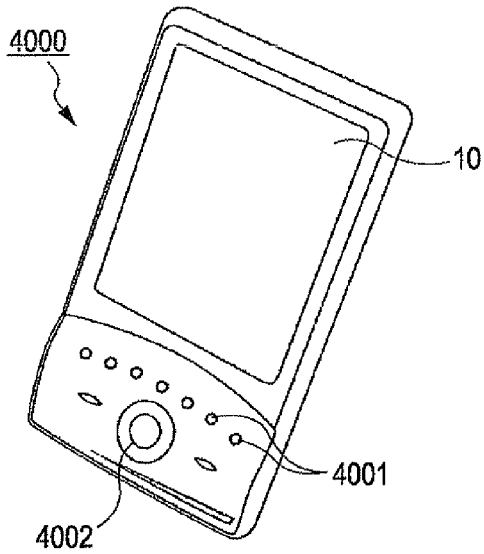
FIG. 17 is a perspective view illustrating still another electronic device to which the electro-optical apparatus according to embodiments of the invention is applied.

FIG. 17 illustrates a PDA (Personal Digital Assistant) to which the electro-optical apparatus 10 according to the embodiments is applied. A PDA 4000 includes a plurality of manipulation buttons 4001, a power switch 4002, and the electro-optical apparatus 10 which is a display apparatus. If the power switch 4002 is manipulated, a variety of information such as an address list or a schedule book is displayed in the electro-optical apparatus 10.

As electronic devices to which the electro-optical apparatus according to the invention is applied, there are exemplified digital still cameras, televisions, video cameras, car navigation apparatuses, pagers, electronic notebooks, electronic paper, calculators, word processors, work stations, television telephones, POS terminals, video players, devices having a touch panel, or the like, in addition to those as shown in FIG. 15 to FIG. 17.

The entire disclosure of Japanese Patent Application No. 2009-089617 filed Apr. 1, 2009 is expressly incorporated by reference herein.

What is claimed is:

1. An electro-optical apparatus comprising:

a plurality of unit circuits which is arranged to correspond to intersections of a plurality of scanning lines and a plurality of data lines;

wherein each data line includes an even number of wirings, and wherein a half of the wirings are arranged on one side of the unit circuit and the remaining half thereof are arranged on the other side of the unit circuit;

a scanning line driving circuit which sequentially selects one scanning line in every driving period included in a unit period; and a data line driving circuit which outputs data electric potentials corresponding to gradation data of the unit circuits corresponding to the scanning line selected in the driving period in the unit period to any one of the respective wirings included in each data line, in every writing period which is included in each unit period before the driving period begins, wherein each of the plurality of unit circuits includes:

an electro-optical element which provides gradation corresponding to the data electric potential;

a capacitor element which has a first electrode connected to a capacitor line and a second electrode directly connected to one of the respective wirings arranged on the one side of the data line; and a switching element which has a first electrode directly connected to the second electrode of the capacitor element, a second electrode directly connected to the electro-optical element, and is switched on when the scanning line is selected by the scanning line driving circuit so as to conduct between the second electrode of the capacitor element and the electro-optical element, and wherein the second electrode of the capacitor element included in another unit circuit arranged in a column along an extension direction of the data line is directly connected to another wiring of the respective wirings included in the data line arranged on the other side of the unit circuit.

2. The electro-optical apparatus according to claim 1, wherein the unit period relating to one of the unit circuits overlaps with at least part of the unit period relating to another unit circuit.

3. An electronic device comprising the electro-optical apparatus according to claim 2.

4. The electro-optical apparatus according to claim 1, wherein the data line driving circuit includes: a switching unit which determines which wiring of the respective wirings the data electric potential is supplied to.

5. An electronic device comprising the electro-optical apparatus according to claim 4.

6. The electro-optical apparatus according to claim 1, wherein the data line driving circuit at least includes: a first data electric potential generating unit which generates the data electric potential supplied for one wiring of the respective wirings arranged on the one side of the unit circuit; and a second data electric potential generating unit which generates the data electric potential supplied for another wiring of the respective wirings arranged on the other side of the unit circuit independently of the generation of the data electric potential in the first data electric potential generating unit.

7. An electronic device comprising the electro-optical apparatus according to claim 6.

8. The electro-optical apparatus according to claim 1, further comprising: an auxiliary capacitor element which has an electrode connected to the wiring, in addition to the capacitor element in each unit circuit or the capacitance associated with the wiring.

9. An electronic device comprising the electro-optical apparatus according to claim 8.

10. The electro-optical apparatus according to claim 1, wherein one unit circuit and another unit circuit form a single unit circuit group which is adjacently arranged along the extension direction of the data line, and wherein the unit circuit group is repeatedly arranged along the extension direction of the data line.

11. An electronic device comprising the electro-optical apparatus according to claim 10.

12. An electronic device comprising the electro-optical apparatus according to claim 1.

13. An electro-optical apparatus comprising:

a plurality of unit circuits which is arranged to correspond to intersections of a plurality of scanning lines and a plurality of data lines;

wherein each data line includes an even number of wirings, and wherein a half of the wirings is arranged on one side of the unit circuit and the remaining half thereof is arranged on the other side of the unit circuit;

a scanning line driving circuit which sequentially selects one scanning line in every driving period included in a unit period;

a data line driving circuit which outputs data electric potentials corresponding to gradation data of the unit circuits corresponding to the scanning line selected in the driving period in the unit period to any one of the respective wirings included in each data line on one side of the unit circuit, in every writing period which is included in each unit period before the driving period begins; and a plurality of first switching elements which are directly connected to the respective wirings included in the plurality of data lines and the data line driving circuit, wherein each of the plurality of unit circuits includes:

an electro-optical element which provides gradation corresponding to the data electric potential;

a capacitor element which has a first electrode connected to a capacitor line and a second electrode directly connected to one of the respective wirings arranged on the one side of the data line; and a second switching element which has a first electrode directly connected to the second electrode of the capacitor element, a second electrode directly connected to the electro-optical element, and is switched on when the scanning line is selected by the scanning line driving circuit so as to conduct between the second electrode of the capacitor element and the electro-optical element, wherein the second switching element included in another unit circuit arranged in a column along an extension direction of the data line is directly connected to another wiring of the respective wirings included in the data line arranged on the other side of the unit circuit, and wherein when the data line driving circuit outputs the data electric potential to one wiring included in the data line arranged on the one side of the unit circuit, the first switching element corresponding to the wiring is switched on in the writing period and conducts between the wiring and the data line driving circuit to store electric charges corresponding to the data electric potential in capacitance associated with the wiring, and is switched off in the driving period and cuts off the conduction between the wiring and the data line driving circuit.

14. An electronic device comprising the electro-optical apparatus according to claim 13.

15. A driving method of an electro-optical apparatus including a plurality of unit circuits which is arranged to correspond to intersections of a plurality of scanning lines and a plurality of data lines, a data line among the plurality of data lines being formed by an even number of wirings, wherein half of the wirings are arranged on one side of a unit circuit among the plurality of unit circuits and the remaining half are thereof are arranged on an other side of another unit circuit, wherein each of the plurality of unit circuits includes a capacitor element which has a first electrode connected to a capacitor line and a second electrode directly connected to one of the respective wirings arranged on the one side of the data line, and an electro-optical element which provides predetermined gradation according to discharging of the capacitor element, the method comprising the steps of:

supplying a first data electric potential to one wiring included in the data line arranged on the one side of the unit circuit to store electric charges corresponding to the first data electric potential in the capacitor element directly connected to the one wiring arranged on the one side of the unit circuit;

discharging the electric charges stored in the capacitor element directly connected to the one wiring arranged on the one side of the unit circuit to supply a voltage or electric current corresponding to the electric charges to the electro-optical element corresponding to the capacitor element;

supplying a second data electric potential to another wiring included in the data line arranged on the other side of the another unit circuit to store electric charges corresponding to the second data electric potential in the capacitor element directly connected to the other wiring arranged on the other side of the another unit circuit; and discharging the electric charges stored in the capacitor element directly connected to the other wiring arranged on the other side of the another unit circuit to supply a voltage or electric current corresponding to the electric charges to the electro-optical element corresponding to the capacitor element.

16. The method according to claim 15, wherein the step of supplying a first data electric potential is performed in parallel with at least one of the step of supplying a second data electric potential and the step of discharging the electric charges stored in the capacitor element directly connected to the other wiring arranged on the other side of the another unit circuit, or the step of supplying a second data electric potential is performed in parallel with at least one of the step of supplying a first data electric potential and the step of discharging the electric charges stored in the capacitor element directly connected to the one wiring arranged on the one side of the unit circuit.

17. A driving method of an electro-optical apparatus including a plurality of unit circuits which is arranged to correspond to intersections of a plurality of scanning lines and a plurality of data lines, a data line among the plurality of unit circuits formed by an even number of wirings, wherein half of the wirings are arranged on one side of a unit circuit and the remaining half are thereof are arranged on an other side of another unit circuit, wherein each of the plurality of unit circuits includes a capacitor element which has a first electrode connected to a capacitor line and a second electrode directly connected to one of the respective wirings arranged on the one side of the data line, and an electro-optical element which is connected to any one of the respective wirings arranged on the one side of the unit circuit and provides predetermined gradation according to discharging of capacitance directly associated with the wiring, the method comprising the steps of:

supplying a first data electric potential to one wiring included in the data line arranged on the one side of the unit circuit to store electric charges corresponding to the first data electric potential in the capacitance directly associated with the one wiring arranged on the one side of the unit circuit;

discharging the electric charges stored in the capacitance directly associated with the one wiring arranged on the one side of the unit circuit to supply a voltage or electric current corresponding to the electric charges to the electro-optical element corresponding to the one wiring arranged on the one side of the unit circuit;

supplying a second data electric potential to another wiring included in the data line arranged on the other side of the another unit circuit to store electric charges corresponding to the second data electric potential in the capacitance directly associated with the other wiring arranged on the other side of the another unit circuit; and discharging the electric charges stored in the capacitance directly associated with the other wiring arranged on the other side of the another unit circuit to supply a voltage or electric current corresponding to the electric charges to the electro-optical element corresponding to the other wiring arranged on the other side of the another unit circuit.

* * * * *